US011572687B2

(12) United States Patent
Gupta et al.

(10) Patent No.: US 11,572,687 B2
(45) Date of Patent: Feb. 7, 2023

(54) MAST ASSEMBLY FOR DRILLING RIG

(71) Applicant: Nabors Drilling Technologies USA, Inc., Houston, TX (US)

(72) Inventors: Ashish Gupta, Houston, TX (US); Padira Reddy, Richmond, TX (US); Denver Lee, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 17/727,514

(22) Filed: Apr. 22, 2022

(65) Prior Publication Data

US 2022/0243456 A1 Aug. 4, 2022

Related U.S. Application Data

(63) Continuation of application No. 16/514,595, filed on Jul. 17, 2019, now Pat. No. 11,339,565.

(60) Provisional application No. 62/700,766, filed on Jul. 19, 2018.

(51) Int. Cl.

| | |
|---|---|
| ***E21B 15/00*** | (2006.01) |
| ***E04B 1/343*** | (2006.01) |
| ***E04B 1/34*** | (2006.01) |
| ***E04H 12/34*** | (2006.01) |
| ***E21B 19/07*** | (2006.01) |
| ***E21B 19/083*** | (2006.01) |
| ***E21B 21/10*** | (2006.01) |
| *E21B 19/10* | (2006.01) |

(52) U.S. Cl.

CPC ..... *E04B 1/343* (2013.01); *E04B 1/3404* (2013.01); *E04H 12/34* (2013.01); *E21B 15/00* (2013.01); *E21B 15/006* (2013.01); *E21B 19/07* (2013.01); *E21B 19/083* (2013.01); *E21B 21/106* (2013.01); *E21B 19/10* (2013.01)

(58) Field of Classification Search

CPC ..... E04B 1/343; E04B 1/3404; E04H 12/34; E21B 15/00; E21B 15/006; E21B 19/07; E21B 19/083; E21B 19/10; E21B 21/106

See application file for complete search history.

(56) References Cited

U.S. PATENT DOCUMENTS

| | | | | |
|---|---|---|---|---|
| 7,107,875 | B2 * | 9/2006 | Haugen | E21B 21/106 81/57.33 |
| 9,441,423 | B2 * | 9/2016 | Donnally | E21B 7/02 |
| 2004/0211598 | A1 * | 10/2004 | Palidis | E21B 7/02 175/203 |
| 2010/0193247 | A1 * | 8/2010 | Riddle | E21B 19/083 175/57 |
| 2013/0192895 | A1 * | 8/2013 | Krohn | E21B 3/022 175/57 |

(Continued)

*Primary Examiner* — Taras P Bemko
(74) *Attorney, Agent, or Firm* — Ewing & Jones, PLLC

(57) ABSTRACT

A mast assembly for a drilling rig includes a mast formed from a plurality of mast subunits. The mast assembly includes a lower drilling machine, upper drilling machine, and upper mud assembly, each of which is coupled to and movable vertically relative to the mast. The mast subunits are separable when the mast is in a transport configuration such that the LDM is positioned in a first subunit and the UDM is in a second subunit of the mast when the mast is in the transport configuration. The mast assembly may be used during a continuous drilling operation.

18 Claims, 34 Drawing Sheets

(56) References Cited

U.S. PATENT DOCUMENTS

| | | | | |
|---|---|---|---|---|
| 2014/0262518 | A1* | 9/2014 | Reddy | E21B 15/00 175/57 |
| 2015/0135607 | A1* | 5/2015 | Ferrari | E21B 15/00 52/745.18 |
| 2016/0010323 | A1* | 1/2016 | Konduc | E21B 7/02 52/69 |
| 2016/0040490 | A1* | 2/2016 | Skjaerseth | E21B 21/01 175/214 |
| 2019/0106945 | A1* | 4/2019 | Basile | E21B 7/02 |

* cited by examiner

MAST ASSEMBLY FOR DRILLING RIG

CROSS-REFERENCE TO RELATED APPLICATIONS

This application is a continuation application which claims priority for U.S. utility application Ser. No. 16/514,595, filed Jul. 17, 2019, which is itself a non-provisional application which claims priority from U.S. provisional application No. 62/700,766, filed Jul. 19, 2018, each of which is hereby incorporated by reference in its entirety.

TECHNICAL FIELD/FIELD OF THE DISCLOSURE

The present disclosure relates to drilling rigs, and specifically to rig structures for drilling in the petroleum exploration and production industry.

BACKGROUND OF THE DISCLOSURE

Land-based drilling rigs may be configured to be moved to different locations to drill multiple wells within the same area, traditionally known as a wellsite. In certain situations, the land-based drilling rigs may travel across an already-drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing wellheads, and may also interfere with raising and lowering of equipment needed for operations.

SUMMARY

The present disclosure provides for a mast assembly for a drilling rig. The mast assembly may include a mast formed from a plurality of mast subunits, a lower drilling machine (LDM) coupled to and movable vertically relative to the mast; an upper drilling machine (UDM) coupled to and movable vertically relative to the mast; and an upper mud assembly (UMA) coupled to and movable vertically relative to the mast, wherein the mast subunits are separable when the mast is in a transport configuration such that the LDM is positioned in a first subunit and the UDM is in a second subunit of the mast when the mast is in the transport configuration.

The present disclosure also provides for a method of rigging-down a mast assembly. The method may include moving an LDM downward into a first subunit of a mast in a vertical position; moving a UDM downward into a second subunit of the mast; moving a UMA into a third subunit of the mast; moving the mast into a horizontal position; and disconnecting the first, second, and third subunits of the mast The present disclosure also provides for a method. The method may include positioning a drilling rig at a wellsite. The drilling rig may include a mast assembly. The mast assembly may include a mast formed from a plurality of mast subunits; a lower drilling machine (LDM) coupled to and movable vertically relative to the mast; an upper drilling machine (UDM) coupled to and movable vertically relative to the mast; and an upper mud assembly (UMA) coupled to and movable vertically relative to the mast. The UMA may include a drilling mud supply pipe adapted to supply drilling fluid to a tubular member gripped by the UDM defining an upper flow path. The mast subunits may be separable when the mast is in a transport configuration such that the LDM is positioned in a first subunit and the UDM is in a second subunit of the mast when the mast is in the transport configuration. The method may include continuously drilling a wellbore using the drilling rig.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
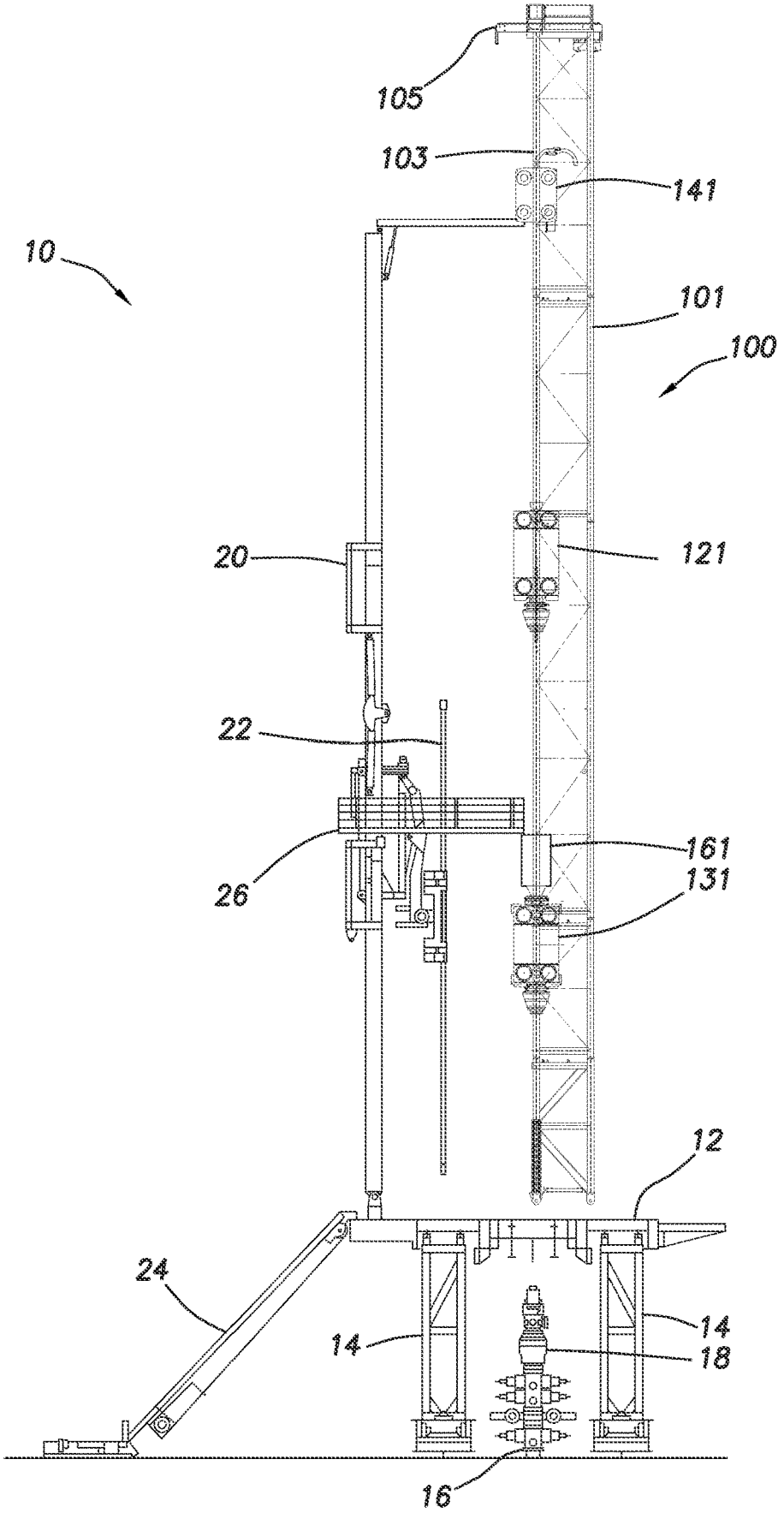
FIG. 1 depicts a side view of a drilling rig including a mast assembly consistent with at least one embodiment of the present disclosure in the rigged-up configuration.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a side view of drilling rig 10. Drilling rig 10 may include drilling rig floor 12 and one or more substructures 14 positioned to support drilling rig 10 above wellbore 16 and other equipment located on the wellhead including, for example and without limitation, blowout preventer (BOP) 18. In some embodiments, drilling rig 10 may include pipe handler 20. Pipe handler 20 may be coupled to drilling rig 10 and may be adapted to introduce and position tubular members including, for example and without limitation, drill pipe, casing, collars, or other tubular members within drilling rig 10. In some embodiments, pipe handler 20 may be used to move tubular members, such as tubular member 22, between catwalk 24, racking boards 26, and a position on drilling rig 10 in line with wellbore 16 to be introduced into or removed from a drill string within wellbore 16.

Drilling rig 10 may include mast assembly 100. FIG. 1 depicts mast assembly 100 in an operational or rigged-up configuration on drilling rig 10. As used herein, "rigging up" refers to an operation to reconfigure mast assembly 100 from a transport configuration to an operational or rigged-up configuration. As used herein, "rigging-down" refers to an operation to reconfigure mast assembly 100 from the operational or rigged-up configuration to the transport configuration. Mast assembly 100 may be mechanically coupled to the rest of drilling rig 10 through rig floor 12 or may be coupled to one or more substructures 14. In some embodiments, mast assembly 100 may include racking boards 26. In some embodiments, racking boards 26 may be part of pipe handler 20.

Figure 2:
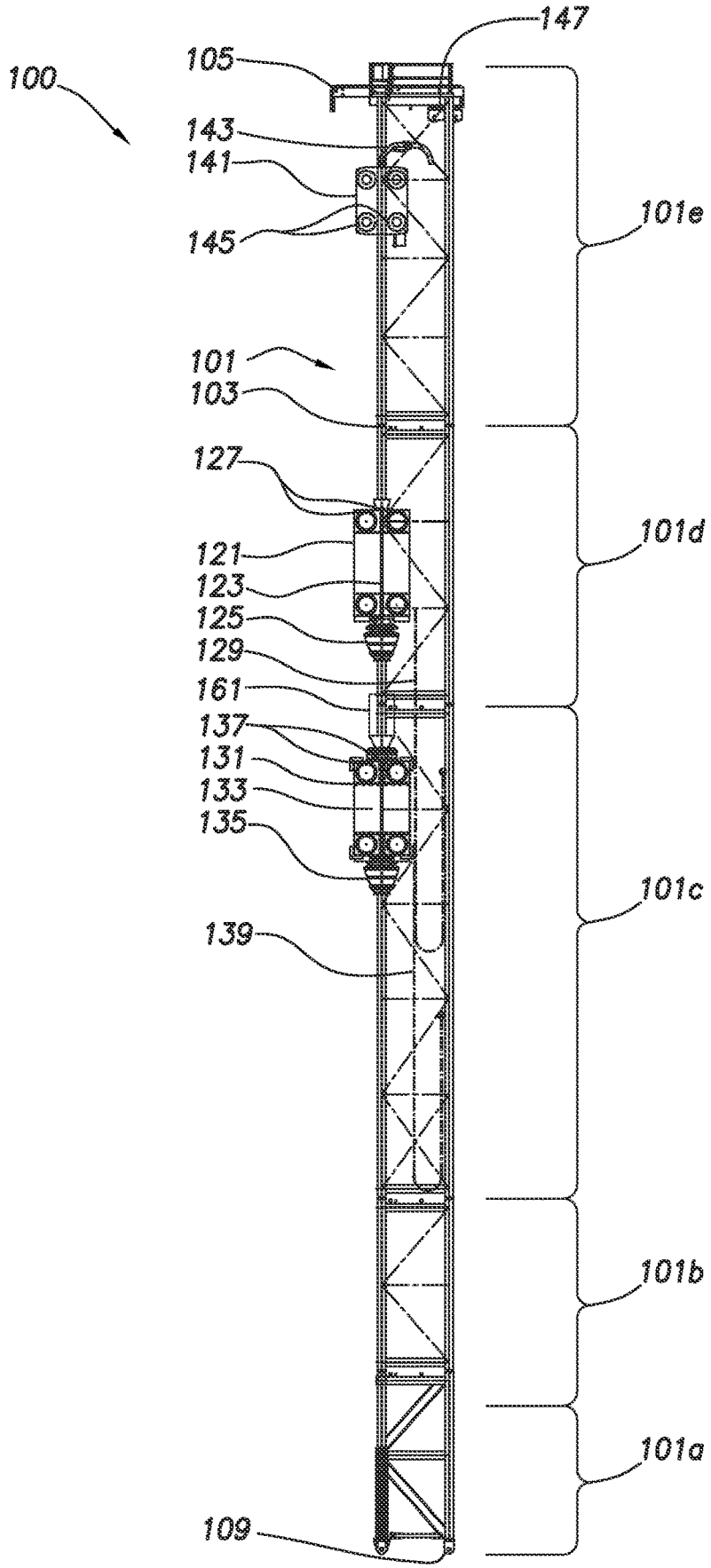
FIGS. 2-9 depict the mast of FIG. 1 during stages of a rigging down or rigging up operation.

In some embodiments, mast assembly 100 may include mast 101. Mast 101, as depicted in FIG. 2, may include a plurality of upright structures that define a frame for mast 101. In some embodiments, mast 101 may include racks 103. Racks 103 may be positioned at a side of mast 101 defining a front of mast 101. Racks 103 may extend vertically substantially along the entire length of mast 101. Racks 103 may be used as part of one or more rack and pinion hoisting systems as further discussed herein below.

In some embodiments, mast 101 may be formed from multiple mast subunits that are joined end-to-end during a rigging-up operation as described further herein below. For the purposes of this disclosure, five mast subunits, mast subunits 101*a*-101*e*, are described. However, one having ordinary skill in the art with the benefit of this disclosure will understand that any number of mast subunits may be utilized to form mast 101 without deviating from the scope of this disclosure. Mast subunits 101*a*-101*e* may be selectively disconnected when mast assembly 100 is configured in the transport configuration to allow each to be independently transported as discussed further below. In some embodiments, mast assembly 100 may be used with a drilling rig when in the rigged-up configuration for use in rig operations including drilling operations.

In some embodiments, mast assembly 100 may include jib boom 105 positioned at an upper end of mast assembly 100. Jib boom 105 may be used, for example and without limitation, for hoisting of drilling rig equipment or other auxiliary components.

In some embodiments, mast assembly 100 may include one or more pieces of drill rig equipment for use during drilling operations. For example, in some embodiments, mast assembly 100 may include a top drive (not shown). In some embodiments, as depicted in FIG. 2, mast assembly 100 may include upper drilling machine (UDM) 121. UDM 121 may be used during a drilling operation to, for example and without limitation, raise and lower tubular members. As used herein, tubular members may include drill pipe, drill collars, casing, or other components of a drill string or components added to or removed from a drill string. In some embodiments, UDM 121 may include UDM clamps 123. UDM clamps 123 may be used, for example and without limitation, to engage a tubular member during a drilling operation. UDM 121 may be adapted to rotate the tubular member engaged by UDM clamps 123. In some embodiments, UDM 121 may include UDM slips 125. UDM slips 125 may be positioned to engage a tubular member to, for example and without limitation, allow UDM 121 to move the tubular member vertically relative to mast 101. In some embodiments, UDM 121 may include UDM pinions 127. UDM pinions 127 may engage racks 103 of mast 101. UDM pinions 127 may be driven by one or more motors including, for example and without limitation, hydraulic or electric motors, in order to move UDM 121 vertically along mast 101. In some embodiments, mast assembly 100 may include UDM drag chain 129. UDM drag chain 129 may, for example and without limitation, couple UDM 121 to one or more supply sources including, for example and without limitation, hydraulic connections, drilling fluid connections, electrical power, water, and compressed air supplies. UDM drag chain 129 may include one or more hoses or cables adapted to operatively couple UDM 121 to the supply sources as UDM 121 moves vertically relative to mast 101.

In some embodiments, mast assembly 100 may include lower drilling machine (LDM) 131. LDM 131 may be used during a drilling operation to, for example and without limitation, raise and lower tubular members. As used herein, tubular members may include drill pipe, drill collars, casing, or other components of a drill string or components added to or removed from a drill string. In some embodiments, LDM 131 may include LDM clamps 133. LDM clamps 133 may be used, for example and without limitation, to engage a tubular member during a drilling operation. LDM 131 may be adapted to rotate the tubular member engaged by LDM clamps 133. In some embodiments, LDM 131 may include LDM slips 135. LDM slips 135 may be positioned to engage a tubular member to, for example and without limitation, allow LDM 131 to move the tubular member vertically relative to mast 101. In some embodiments, LDM 131 may include LDM pinions 137. LDM pinions 137 may engage racks 103 of mast 101. LDM pinions 137 may be driven by one or more motors including, for example and without limitation, hydraulic or electric motors, in order to move LDM 131 vertically along mast 101. In some embodiments, mast assembly 100 may include LDM drag chain 139. LDM drag chain 139 may, for example and without limitation, couple LDM 131 to one or more supply sources including, for example and without limitation, hydraulic connections, drilling fluid connections, electrical power, water, and compressed air supplies. LDM drag chain 139 may include one or more hoses or cables adapted to operatively couple LDM 131 to the supply sources as LDM 131 moves vertically relative to mast 101.

Figure 12:
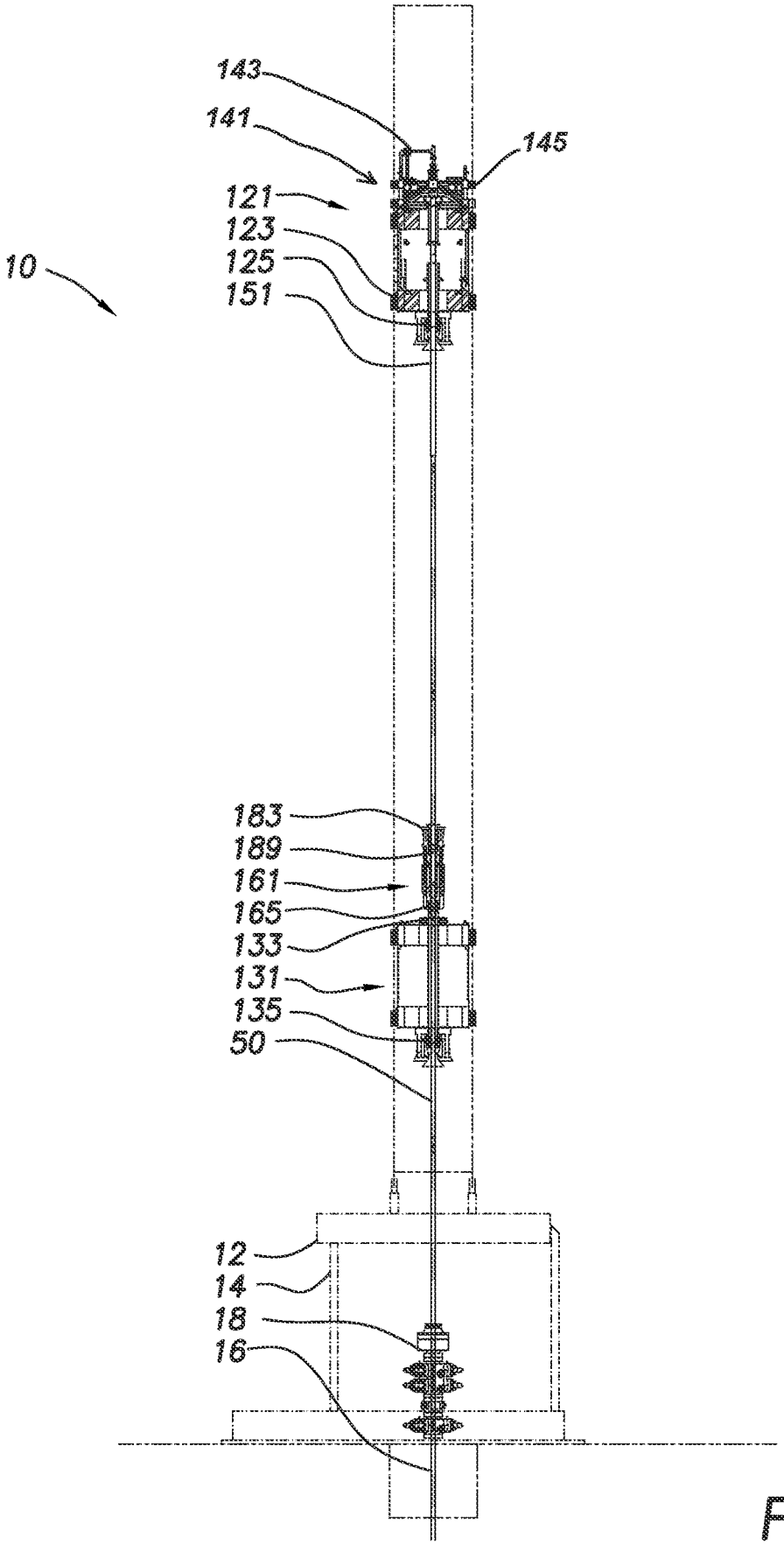
FIGS. 12-21A depict the drilling rig of FIG. 1 in various stages of a continuous drilling operation.

Referring briefly to FIG. 12, in some embodiments, mast assembly 100 may also include a continuous drilling unit (CDU) 161. CDU 161 may be mechanically coupled to the upper end of LDM 131. The construction and operation of CDU 161 are described further herein below.

Referring again to FIG. 2, in some embodiments, UDM 121 and LDM 131 may each be moved independently relative to mast 101. In some embodiments, UDM 121 and LDM 131 may be operated to make-up and break-out connections between tubular members during rig operations including, for example and without limitation, drilling, tripping in, and tripping out operations. In some embodiments, UDM 121 and LDM 131 may each be positioned such that tubulars supported or gripped by UDM 121 or by LDM 131 are aligned with the front of mast 101 and therefore aligned with racks 103 of mast 101.

In some embodiments, mast assembly 100 may include upper mud assembly (UMA) 141. UMA 141 may include drilling mud supply pipe 143 adapted to supply drilling fluid to a tubular member gripped by UDM 121. Drilling mud supply pipe 143 may fluidly couple to the tubular member gripped by UDM 121 and may, for example and without limitation, be used to supply drilling fluid to a drill string during portions of a drilling operation. In some embodiments, UMA 141 may include mud assembly pinions 145. Mud assembly pinions 145 may engage racks 103 of mast 101. In some embodiments, mud assembly pinions 145 may be driven by one or more motors including, for example and without limitation, hydraulic or electric motors, in order to move UMA 141 vertically along mast 101. In other embodiments, UMA 141 may be moved by UDM 121. In other embodiments, UMA 141 may be moved using a separate hoist such as an air hoist. Such a hoist may include sheaves 147 positioned on mast 101.

In some embodiments, in order to rig-down mast assembly 100 for transport, components of mast assembly 100 may be repositioned within mast assembly 100 such that each is positioned within a specific mast subunit 101*a*-101*e* as discussed below. The following discussion is meant as an example of such a rigging-down operation and is not intended to limit the scope of this disclosure as other arrangements of components and mast subunits are contemplated within the scope of this disclosure.

Figure 3:
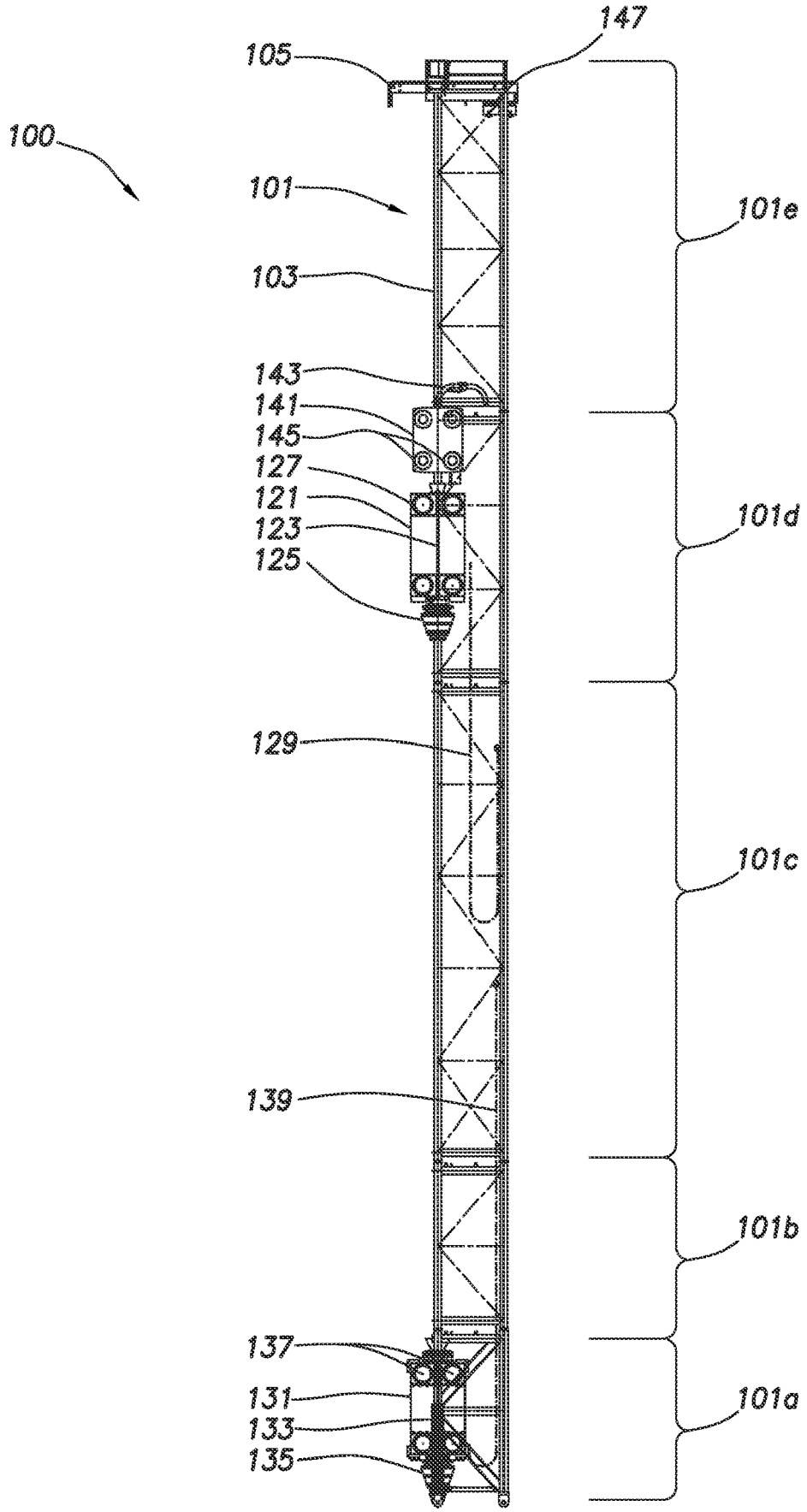

In such a rigging-down operation, any tubular members may be removed from all components of mast assembly 100. In some embodiments, LDM 131 may be lowered into first mast subunit 101*a* as depicted in FIG. 3. First mast subunit 101*a* may, in some embodiments, be the lowermost of mast subunits 101*a*-101*e*. LDM 131 may be lowered using LDM pinions 137. In some embodiments, CDU 161 may be removed from LDM 131 and may be transported separately from the rest of mast assembly 100.

Figure 4:
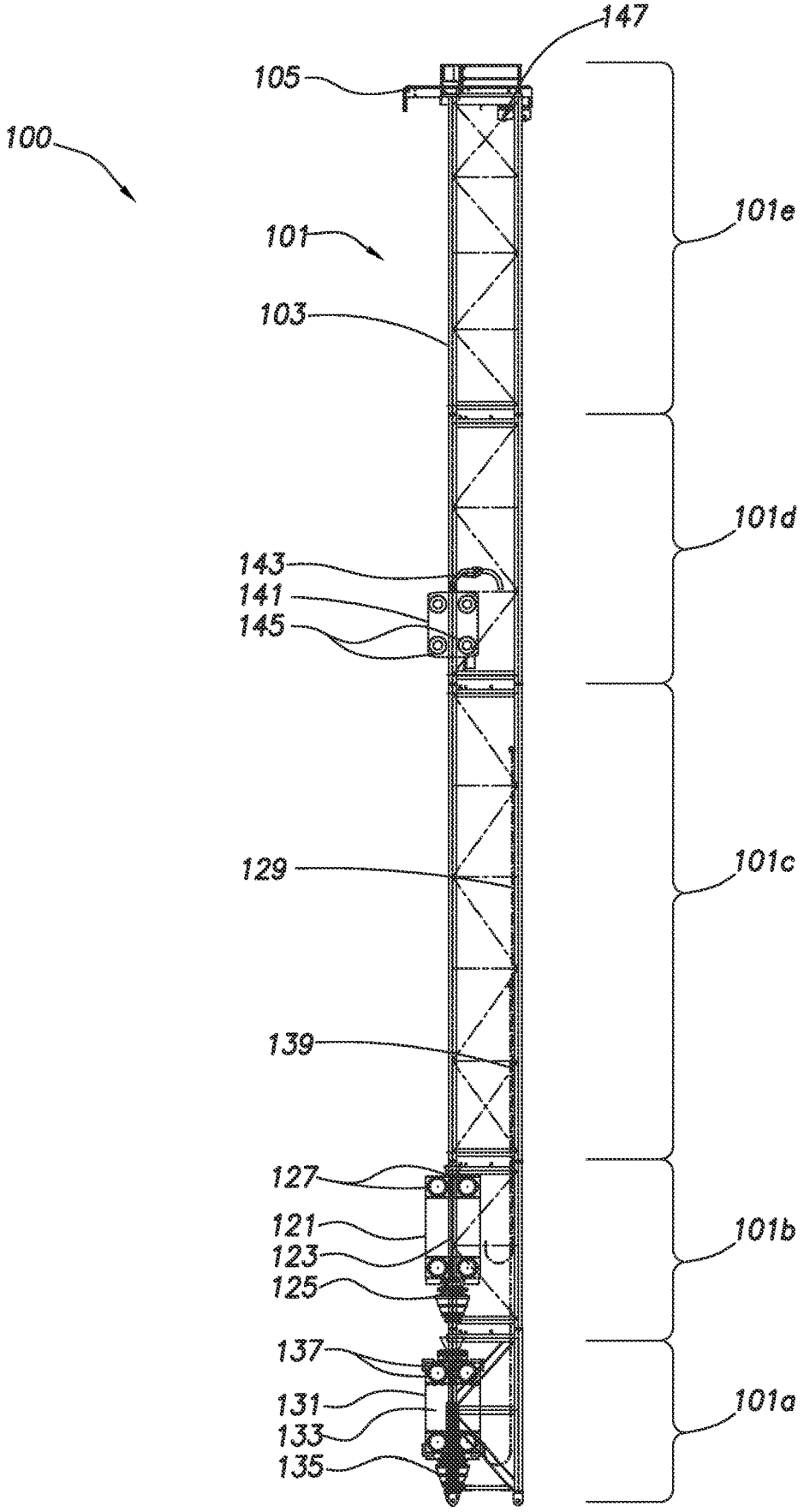

In some embodiments, UDM 121 may be lowered into second mast subunit 101*b* as depicted in FIG. 4. Second mast subunit 101*b* may, in some embodiments, be the second lowermost of mast subunits 101*a*-101*e*. UDM 121 may be lowered using UDM pinions 127. In some embodiments, UMA 141 may be positioned within fourth mast subunit 101*d*. Fourth mast subunit 101*d* may, in some embodiments, be the fourth lowermost of mast subunits 101*a*-101*e*, separated from second mast subunit 101*b* by third mast subunit 101*c*. In some embodiments, UMA 141 may be positioned using one or more of UDM 121, mud assembly pinions 145, or sheaves 147.

Figure 5:
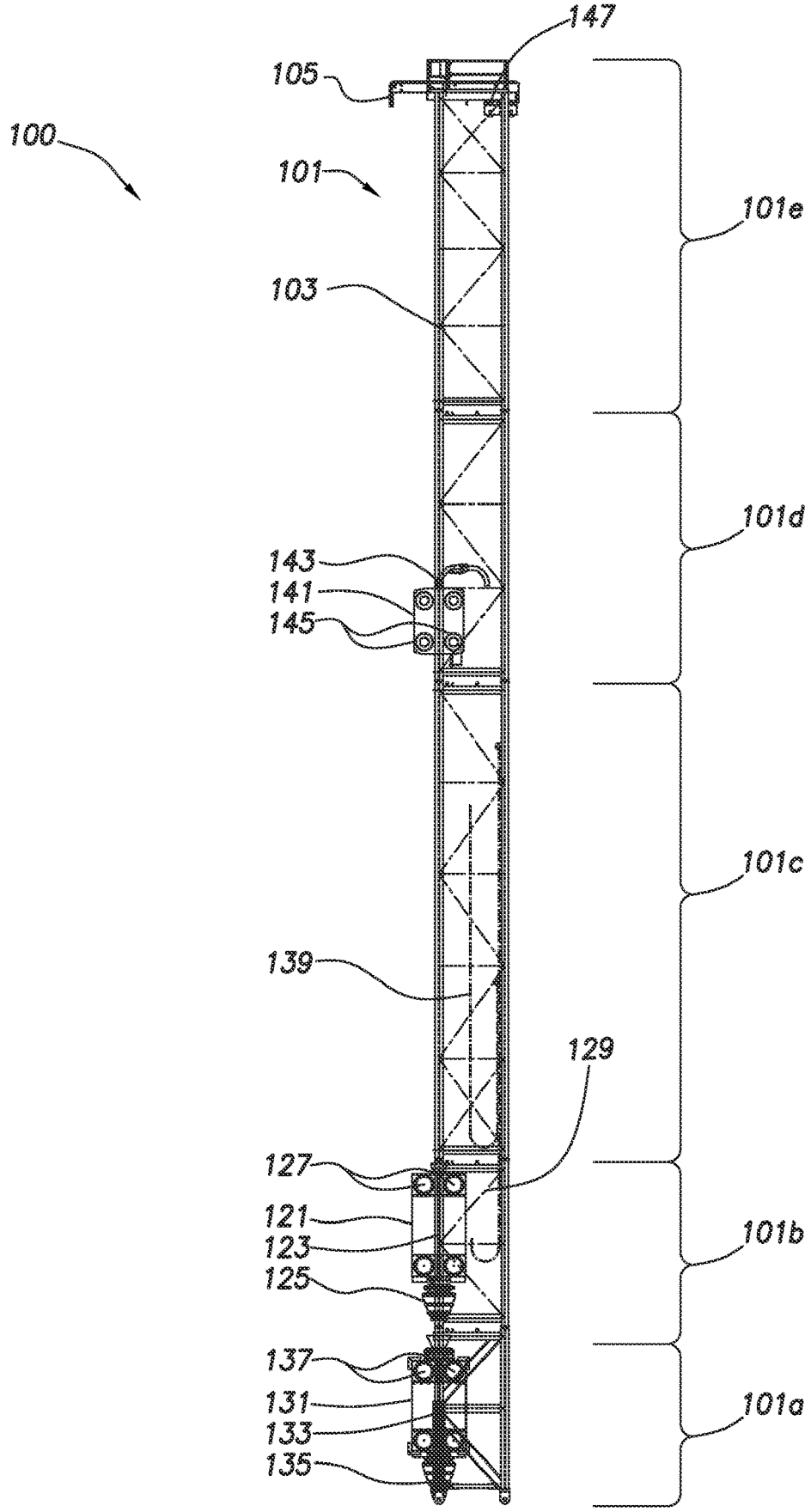
Figure 6:
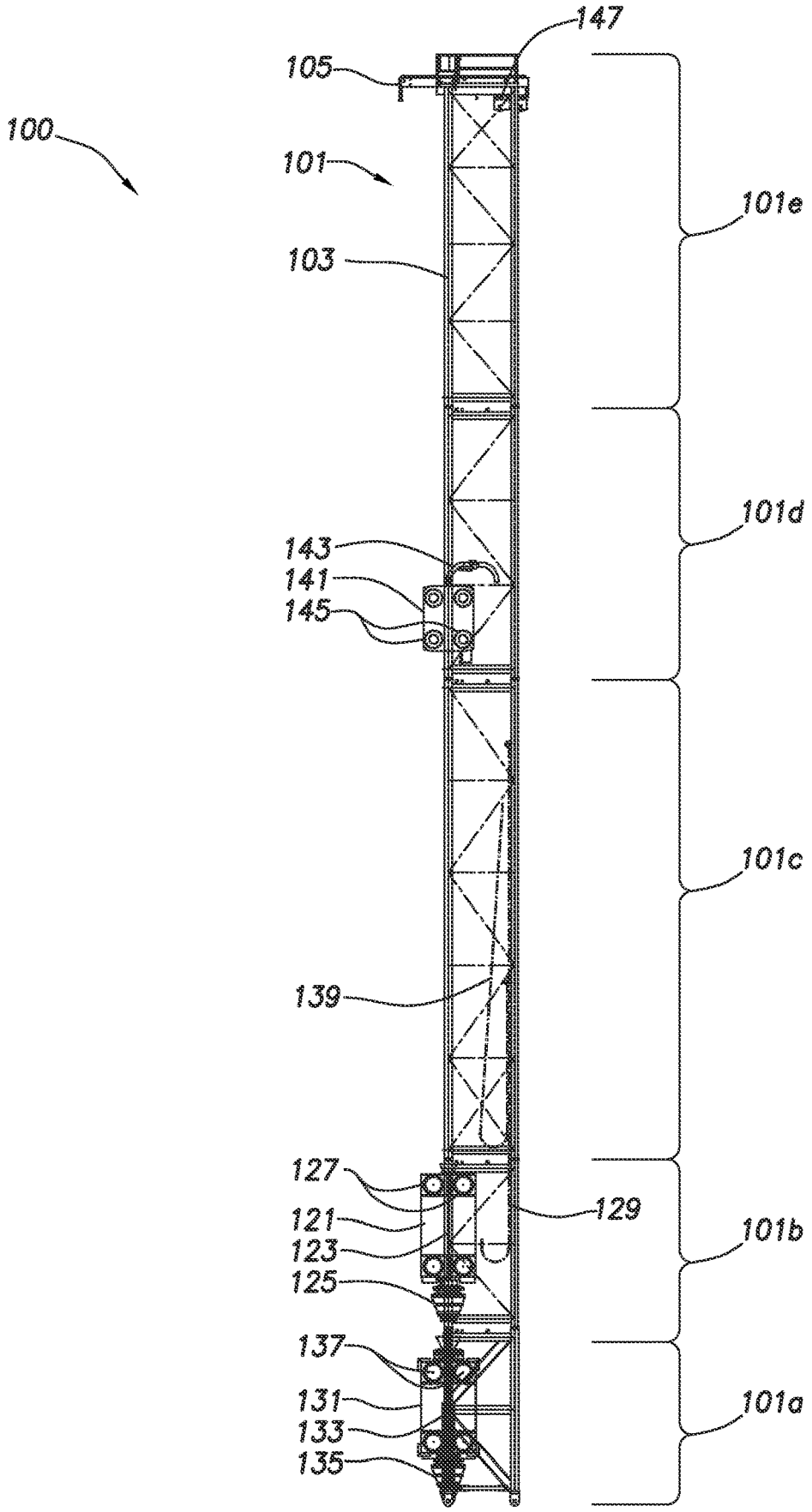

In some embodiments, LDM drag chain 139 may be decoupled from LDM 131 and repositioned such that LDM drag chain 139 is positioned within third mast subunit 101*c* as depicted in FIG. 5. In some such embodiments, the static end of LDM drag chain 139 may remain coupled to supply ports on third mast subunit 101*c* of mast 101. The moving end of LDM drag chain 139 may be secured to third mast subunit 101*c* of mast 101 as depicted in FIG. 6.

Figure 7:
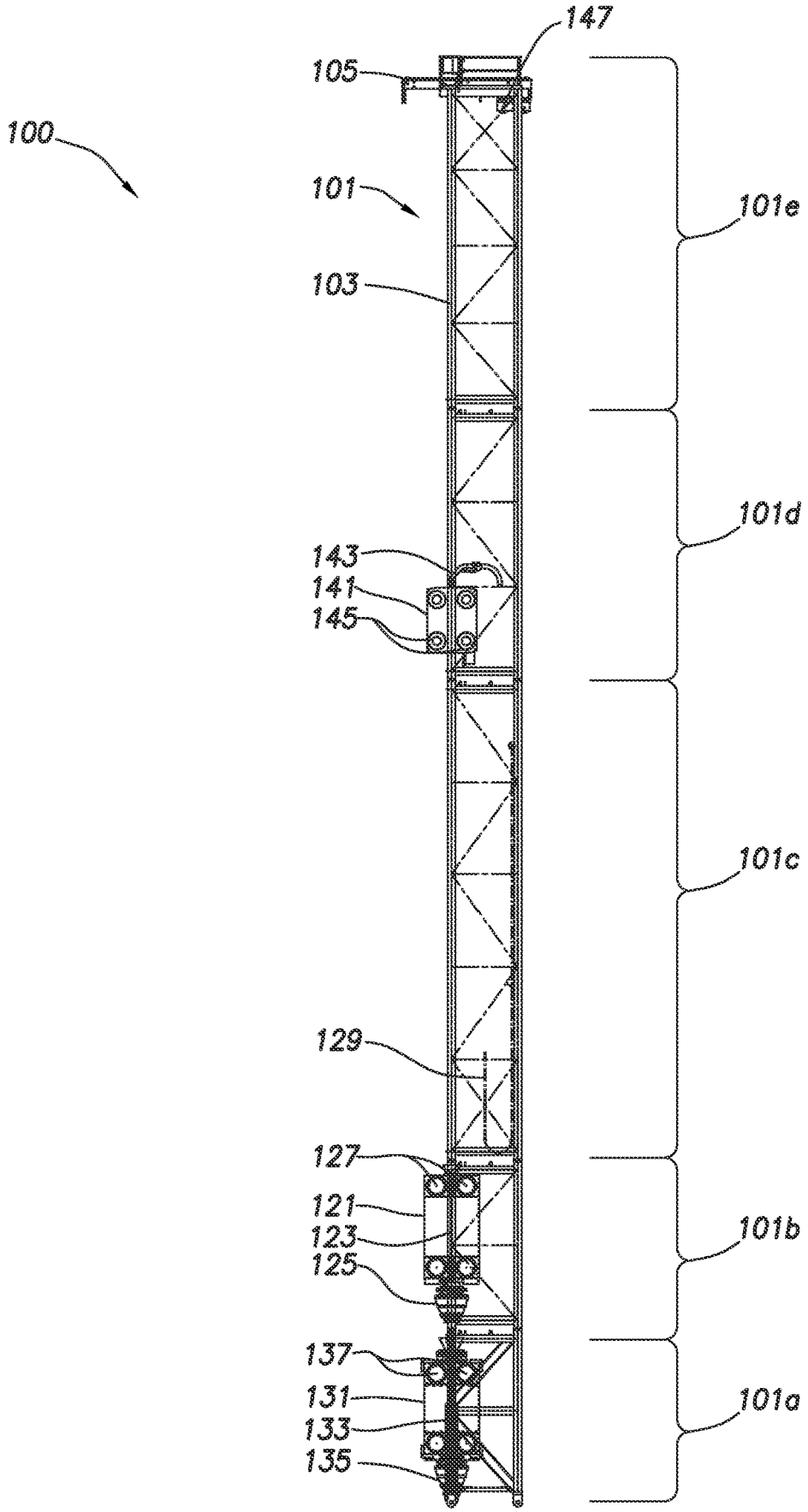
Figure 8:
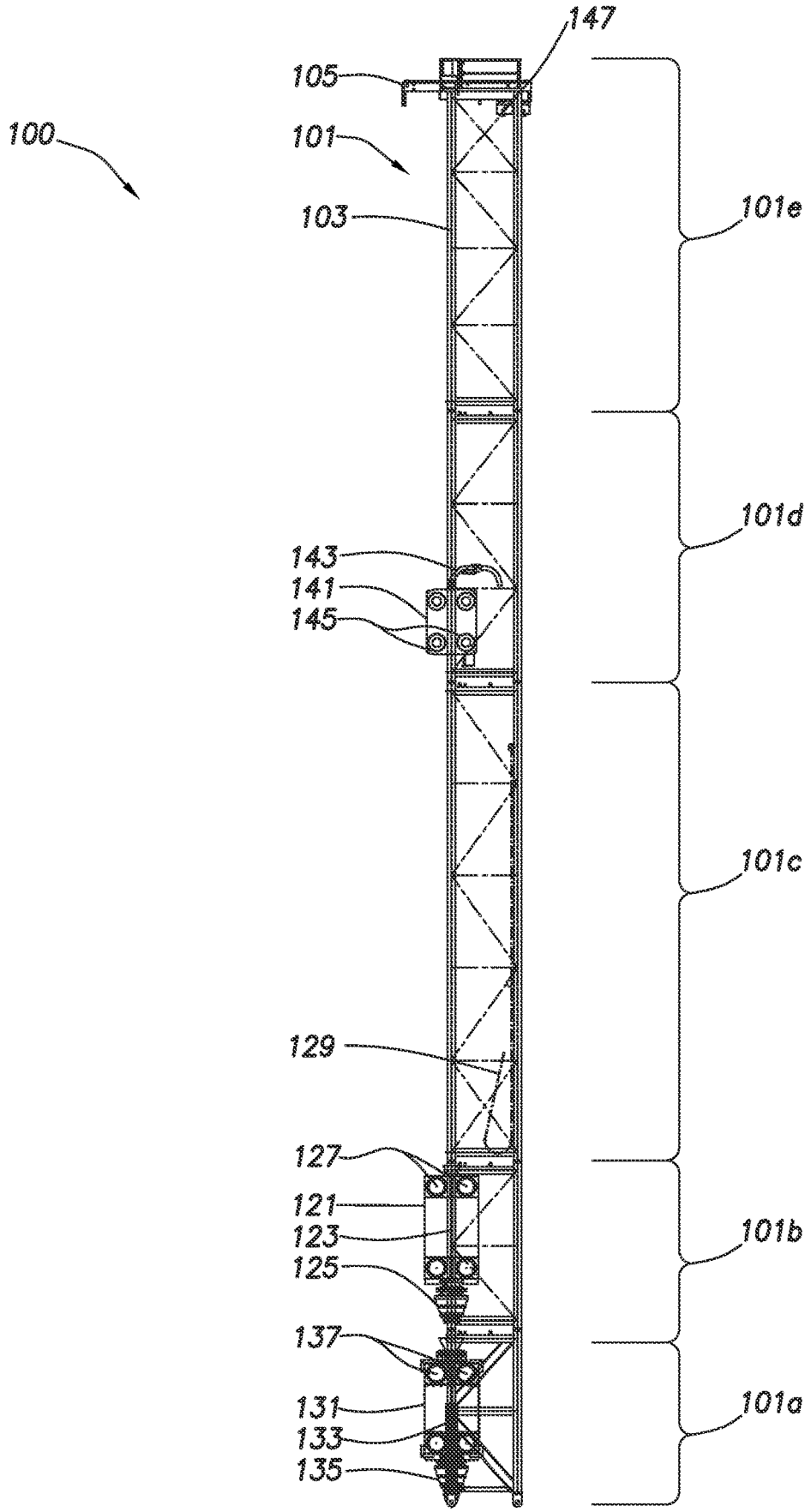

Similarly, in some embodiments, UDM drag chain 129 may be decoupled from UDM 121 and repositioned such that UDM drag chain 129 is positioned within third mast subunit 101*c* as depicted in FIG. 7. In some such embodiments, the static end of UDM drag chain 129 may remain coupled to supply ports on third mast subunit 101*c* of mast 101. The moving end of UDM drag chain 129 may be secured to third mast subunit 101*c* of mast 101 as depicted in FIG. 8.

Figure 9:
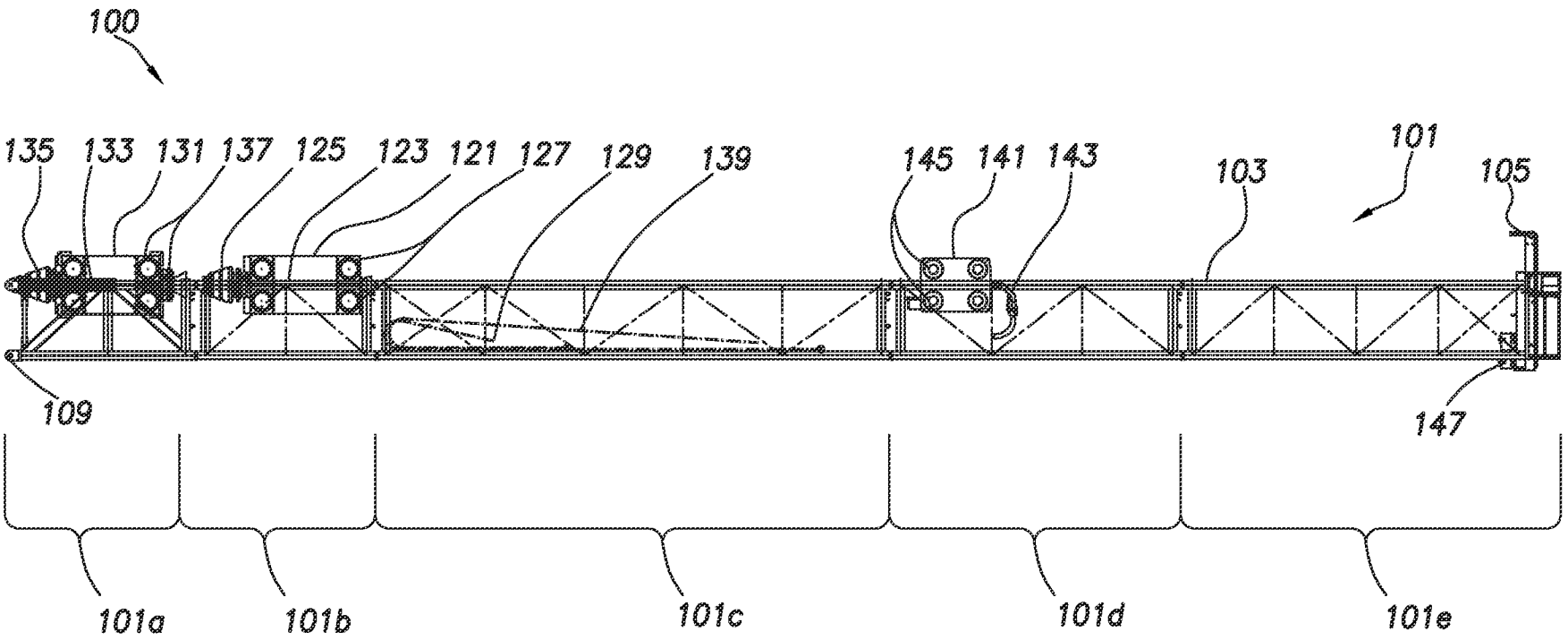

In some embodiments, mast assembly 100 may be lowered from the upright position into a lowered or horizontal position as depicted in FIG. 9. In some such embodiments, mast assembly 100 may be configured to pivot relative to a drilling rig (not shown) at mast pivot points 109. Components of mast assembly 100 including, for example and without limitation, UDM 121, UDM drag chain 129, LDM 131, LDM drag chain 139, and UMA 141 may remain in the positions described above as mast assembly 100 is lowered into the horizontal position.

Figure 10:
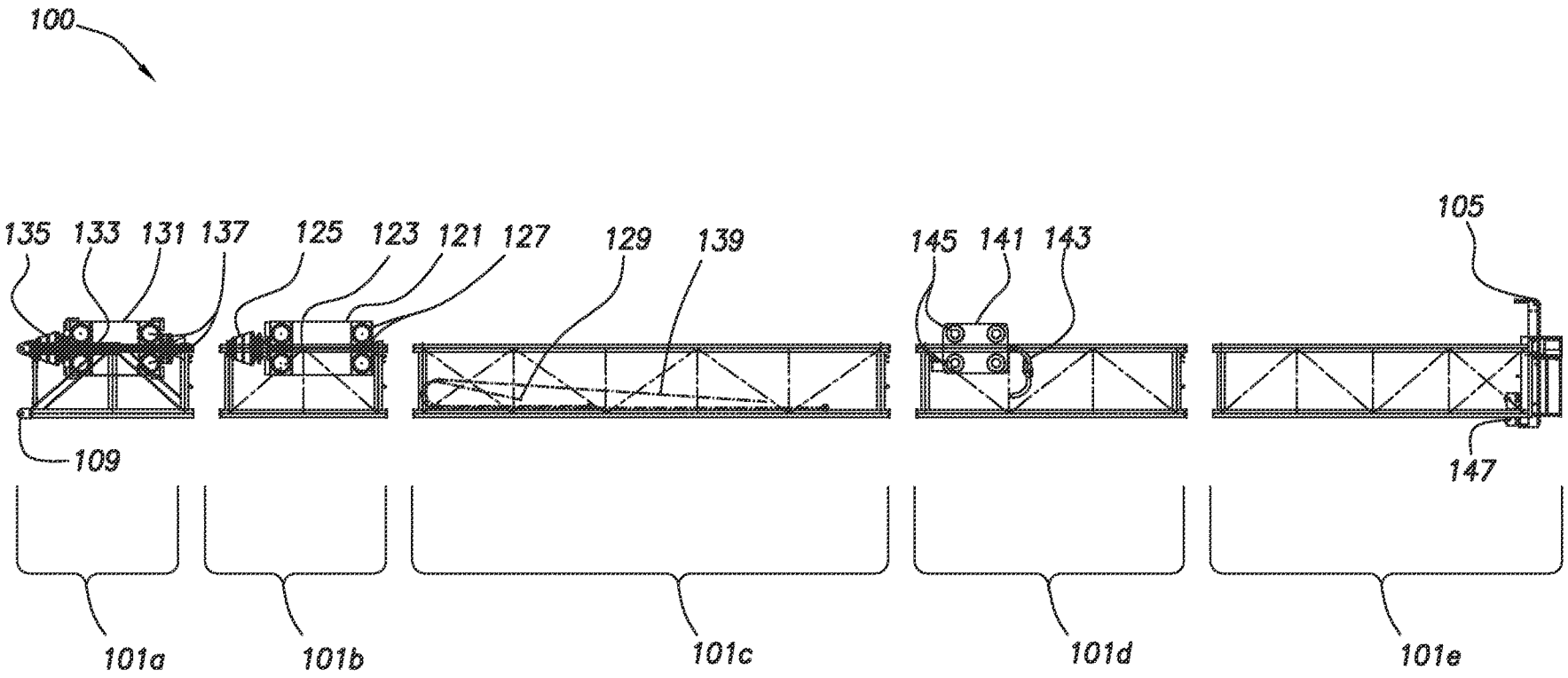
FIG. 10 depicts the mast of FIG. 1 in a transport configuration.

In some embodiments, mast subunits 101*a*-101*e* of mast assembly 100 may be decoupled as depicted in FIG. 10, such that each mast subunit 101*a*-101*e* including any components of mast assembly 100 positioned therein may be transported separately. In some embodiments, each of mast subunits 101*a*-101*e* may be coupled to adjacent mast subunits 101*a*-101*e* by a pinned connection. Each mast subunit 101*a*-101*e* may be transported, for example and without limitation, by a truck-drawn trailer. In such an embodiment, first mast subunit 101*a* may be transported with LDM 131, second mast subunit 101*b* may be transported with UDM 121, third mast subunit 101*c* may be transported with UDM drag chain 129 and LDM drag chain 139, and fourth mast subunit 101*d* may be transported with UMA 141. In some embodiments, the lengths of each mast subunit 101*a*-101*e* may be selected such that the overall weight of the transported section is within a desired maximum weight. In some embodiments, the lengths of each mast subunit 101*a*-101*e* may be selected such that the lengths and weights thereof comply with one or more transportation regulations including, for example and without limitation, permit load ratings. In some embodiments, such an arrangement may allow components that would otherwise be too heavy to transport as a single load to be separated into multiple loads.

In some embodiments, in order to rig-up mast assembly 100, the same operations may be carried out in reverse once mast subunits 101*a*-101*e* have arrived at the location where mast assembly 100 is to be used.

In some embodiments, CDU 161 may be mechanically coupled to an upper end of LDM 131 once mast assembly 100 is fully rigged up to drilling rig 10. As depicted in cross section in FIG. 11, CDU 161 may include lower seal housing 163. Lower seal housing 163 may mechanically couple CDU 161 to LDM 131. Lower seal 165 may be positioned within lower seal housing 163 and may be positioned to seal against an upper end of a tubular member 40. In some embodiments, tubular member 40 may be the uppermost tubular member of a drill string. In some embodiments, lower seal 165 may be positioned to seal against tubular member 40 while tubular member 40 is gripped by one or both of LDM clamps 133 and LDM slips 135 (not shown in FIG. 11) during a drilling operation. Lower seal housing 163 may mechanically couple to circulation housing 167. Circulation housing 167 may include one or more fluid inlets 169 positioned to allow drilling fluid to enter the interior of circulation housing 167 and flow into tubular member 40, defining a lower flow path.

Circulation housing 167 may mechanically couple to valve housing 171. Valve housing 171 houses valve 173 positioned to, when closed, isolate the interior of CDU 161 below valve 173, defining lower chamber 175, from the interior of CDU 161 above valve 173, defining upper chamber 177. Lower chamber 175 may be defined between valve 173 and lower seal 165 and may be in fluid communication with inlets 169. Valve 173 may, in some embodiments, be a flapper valve.

Figure 11:
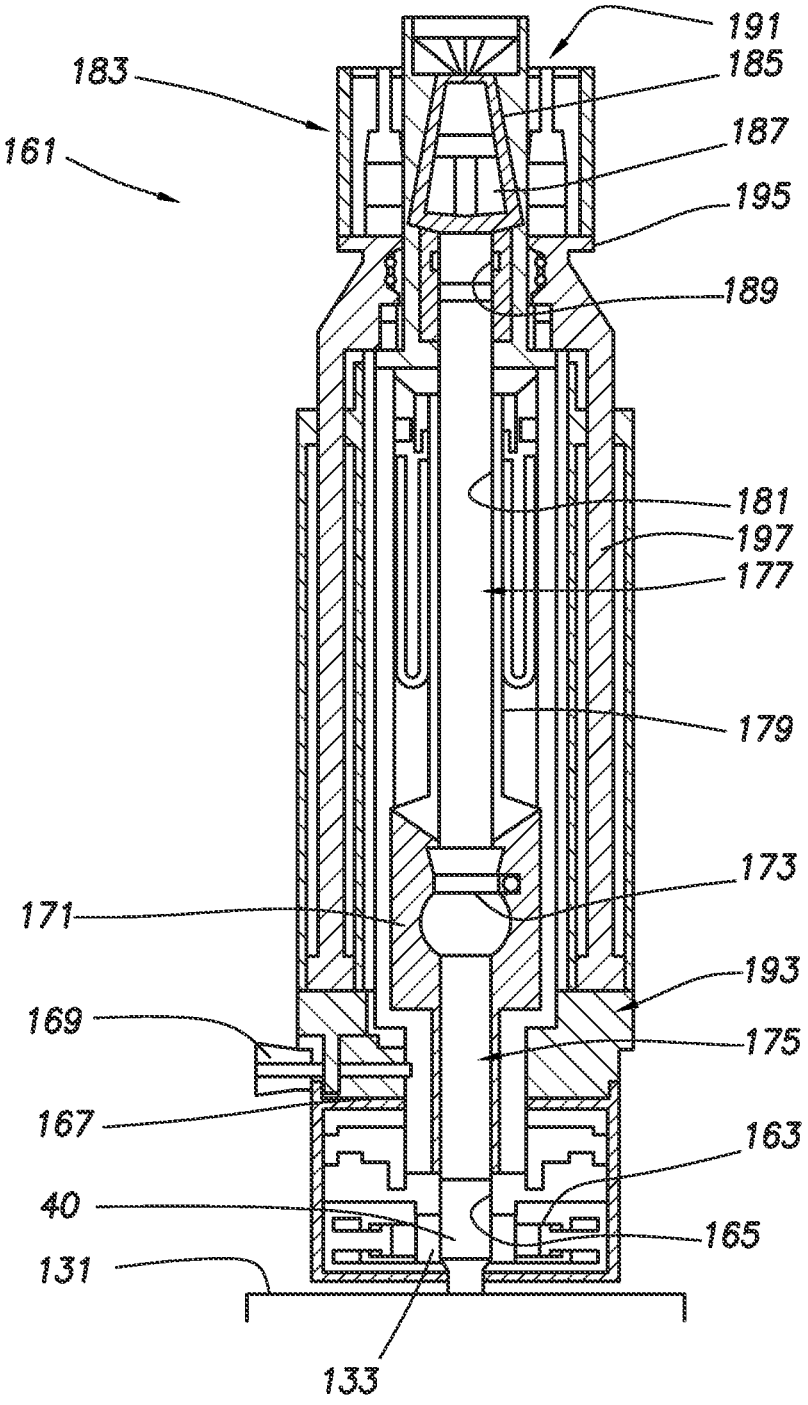
FIG. 11 depicts a cross-section view of a continuous drilling unit (CDU) consistent with at least one embodiment of the present disclosure.

Valve housing 171 may mechanically couple to outer extension barrel 179. Outer extension barrel 179 may be positioned about inner extension barrel 181. Inner extension barrel 181 may slide telescopically within outer extension barrel 179 between a retracted configuration (as shown in FIG. 11) and an extended configuration as further discussed below.

The upper end of inner extension barrel 181 may be mechanically coupled to inverted slips assembly 183. Inverted slips assembly 183 may include slips bowl 185 and one or more wedges 187 positioned to grip to a tubular member as further discussed below. Inner extension barrel 181 may also be mechanically coupled to upper seal 189. Upper seal 189 may be positioned to seal against the outer surface of a tubular member held by inverted slips assembly 183. Upper seal 189 may define an upper end of upper chamber 177. In some embodiments, lower seal housing 163, lower seal 165, circulation housing 167, valve housing 171, valve 173, outer extension barrel 179, inner extension barrel 181, inverted slips assembly 183, and upper seal 189 may define a rotating portion of CDU 161 and may be rotated as a unit by rotation of a tubular member held by inverted slips assembly 183.

In some embodiments, CDU 161 may include a nonrotating outer housing assembly 191. Outer housing assembly 191 may include lower housing 193 and upper housing 195. Like lower seal housing 163, lower housing 193 may be mechanically coupled to LDM 131. Upper housing 195 may be coupled to lower housing 193 by one or more linear actuators 197 to move upper housing 195 axially relative to lower housing 193. In some embodiments, linear actuators 197 may be hydraulic pistons, electromechanical actuators, or any other suitable devices.

In some embodiments, lower seal housing 163, lower seal 165, circulation housing 167, valve housing 171, valve 173, and outer extension barrel 179 may be rotatably mechanically coupled to lower housing 193. In some embodiments, inner extension barrel 181, inverted slips assembly 183, and upper seal 189 may be mechanically coupled to upper housing 195. In some embodiments, one or more bearings may be positioned between components of the rotating portion of CDU 161 and components of outer housing assembly 191.

Upper housing 195 may be moved axially between an extended configuration and a retracted configuration to define an extended configuration and a retracted configuration of CDU 161. As upper housing 195 moves, inner extension barrel 181 moves relative to outer extension barrel 179 while maintaining a seal and thereby maintaining upper chamber 177.

During operation, a tubular member may be inserted into CDU 161 such that the lower end of the tubular member is positioned above valve 173 within upper chamber 177 while upper housing 195 is in the extended configuration and gripped by inverted slips assembly 183, and upper seal 189. Upper housing 195 may then be moved axially with respect to lower housing 193 to the retracted configuration, thereby pushing the lower end of the tubular member through valve 173 into lower chamber 175. In some embodiments, the lower end of the tubular member may be positioned into contact with tubular member 40 in order to make-up a threaded connection therebetween. Likewise, once a connection is broken out, upper housing 195 may be moved to the extended configuration, moving the lower end of an upper tubular member from lower chamber 175 into upper chamber 177, allowing valve 173 to close and isolate lower chamber 175 from upper chamber 177.

In some embodiments, drilling rig 10 with mast assembly 100 as described above may be used during normal drilling operations including, for example and without limitation, conventional drilling, tripping in and out, or other operations. In some such embodiments, UDM 121 or LDM 131 may be used to hoist, position, and rotate a drill string. In some embodiments, UDM 121 and LDM 131 may be used to make up or break out pipe connections to add or remove tubular members from the drill string as discussed herein below with or without the use of UMA 141 and CDU 161. Pipe handler 20 may be used to add or remove tubulars during such operations.

In some embodiments, drilling rig 10 may be used during a continuous drilling operation. In such an embodiment, UDM 121, LDM 131, UMA 141, and CDU 161 may be used to continuously circulate drilling fluid through the drill string during drilling operations without stopping or slowing the rotation of or penetration by the drill string into the subsurface formation during the addition of additional tubular members to the drill string.

For example, FIGS. 12-21 depict a continuous drilling operation consistent with embodiments of the present disclosure as further described below.

FIG. 12 depicts drilling rig 10 during a continuous drilling operation at a stage in the cycle at which UDM 121 is handling the drilling operation. In some embodiments, quill extension 151 may be positioned within UDM 121. Quill extension 151 may be engaged by UDM clamps 123 and UDM slips 125. Quill extension 151 may be coupled to UMA 141 such that UMA 141 allows drilling fluid to flow into quill extension 151, defining an upper flow path. As shown in FIG. 12, quill extension 151 is threadedly coupled to the upper end of drill string 50 such that rotation of quill extension 151 by UDM 121 is transferred to drill string 50 and such that drilling fluid from UMA 141 is circulated through drill string 50. In some embodiments, such as where drilling rig 10 is used for conventional drilling, UMA 141 may supply drilling fluid to drill string 50 directly. UDM 121 rotates drill string 50 at the desired drilling speed and moves downward as drill string 50 penetrates further into the subterranean formation. At this stage, LDM 131 and CDU 161 are not engaged with drill string 50. Specifically, LDM clamps 133, LDM slips 135, lower seal 165, inverted slips assembly 183, and upper seal 189 are disengaged from drill string 50. CDU 161 may be in the retracted configuration. Fluid supply from the lower flow path to inlets 169 is closed, and the weight of drill string 50 is supported by UDM 121.

Figure 13:
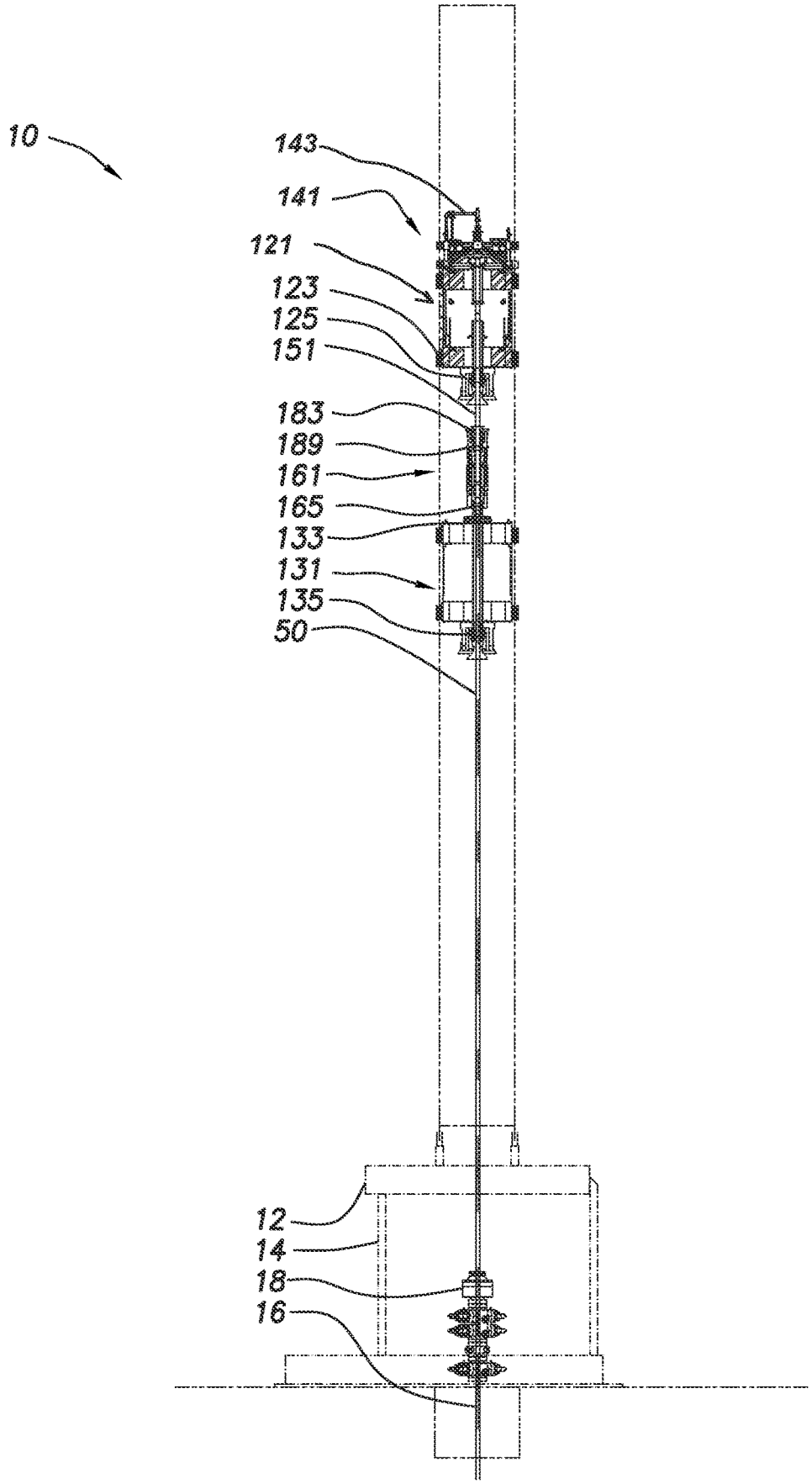
Figure 13A:
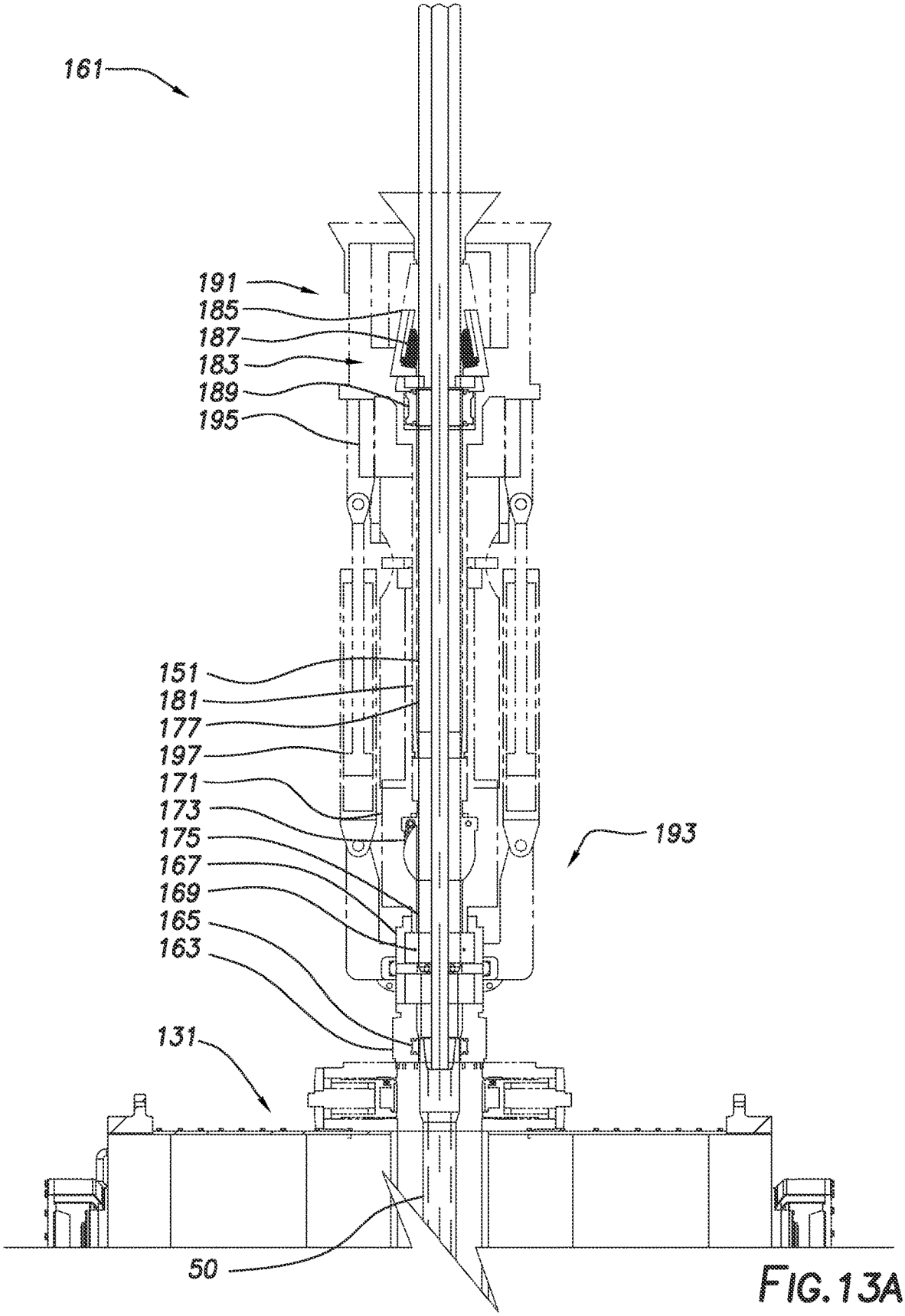

As shown in FIGS. 13 and 13A, LDM 131 may be moved up to a position at which the upper end of drill string 50 is positioned within lower chamber 175 of CDU 161 while quill extension 151 extends through upper chamber 177 and into lower chamber 175 of CDU 161. LDM 131 may be moved downward such that this alignment is maintained despite downward motion of drill string 50 and UDM 121 during the drilling operation.

Figure 13B:
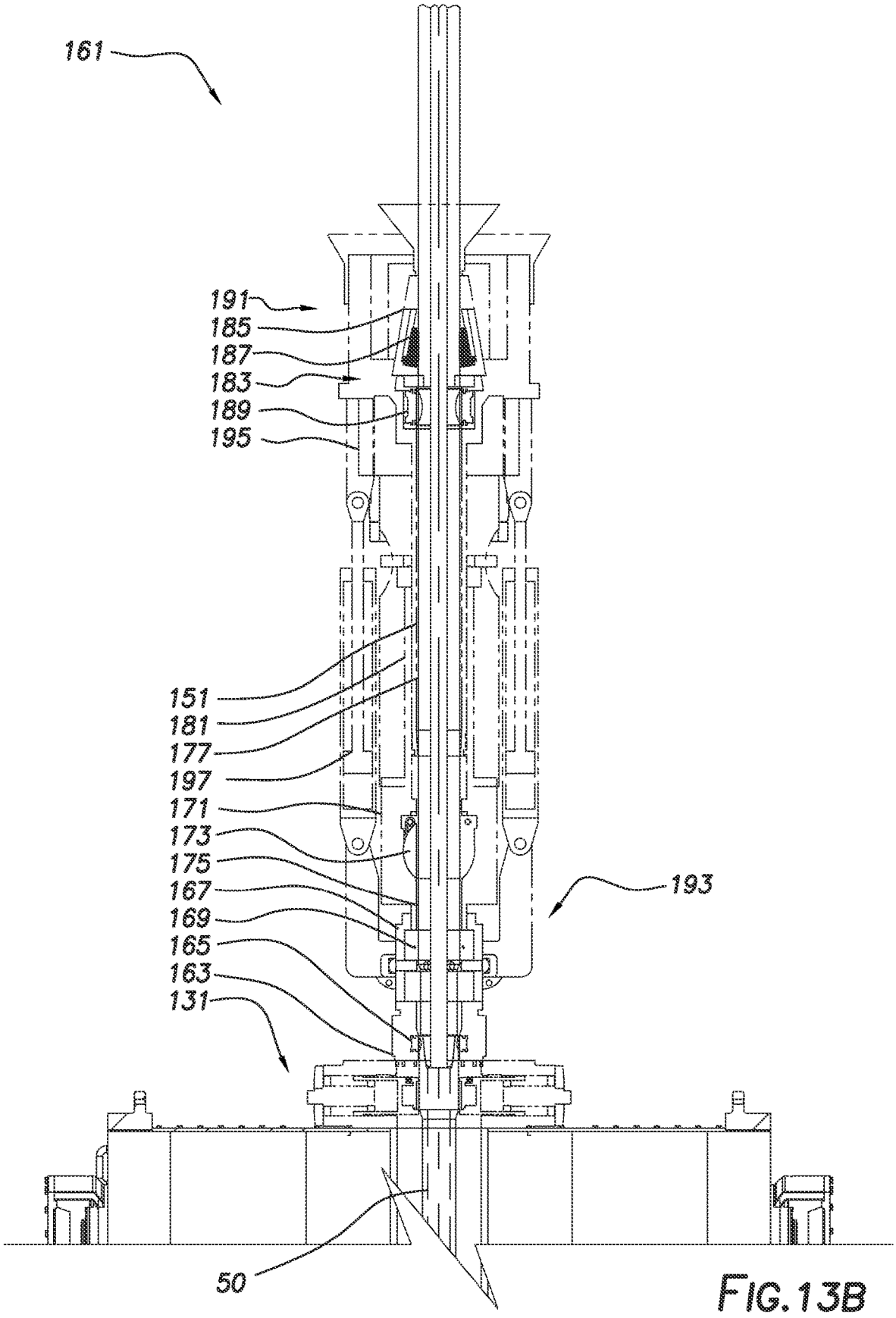
Figure 13C:
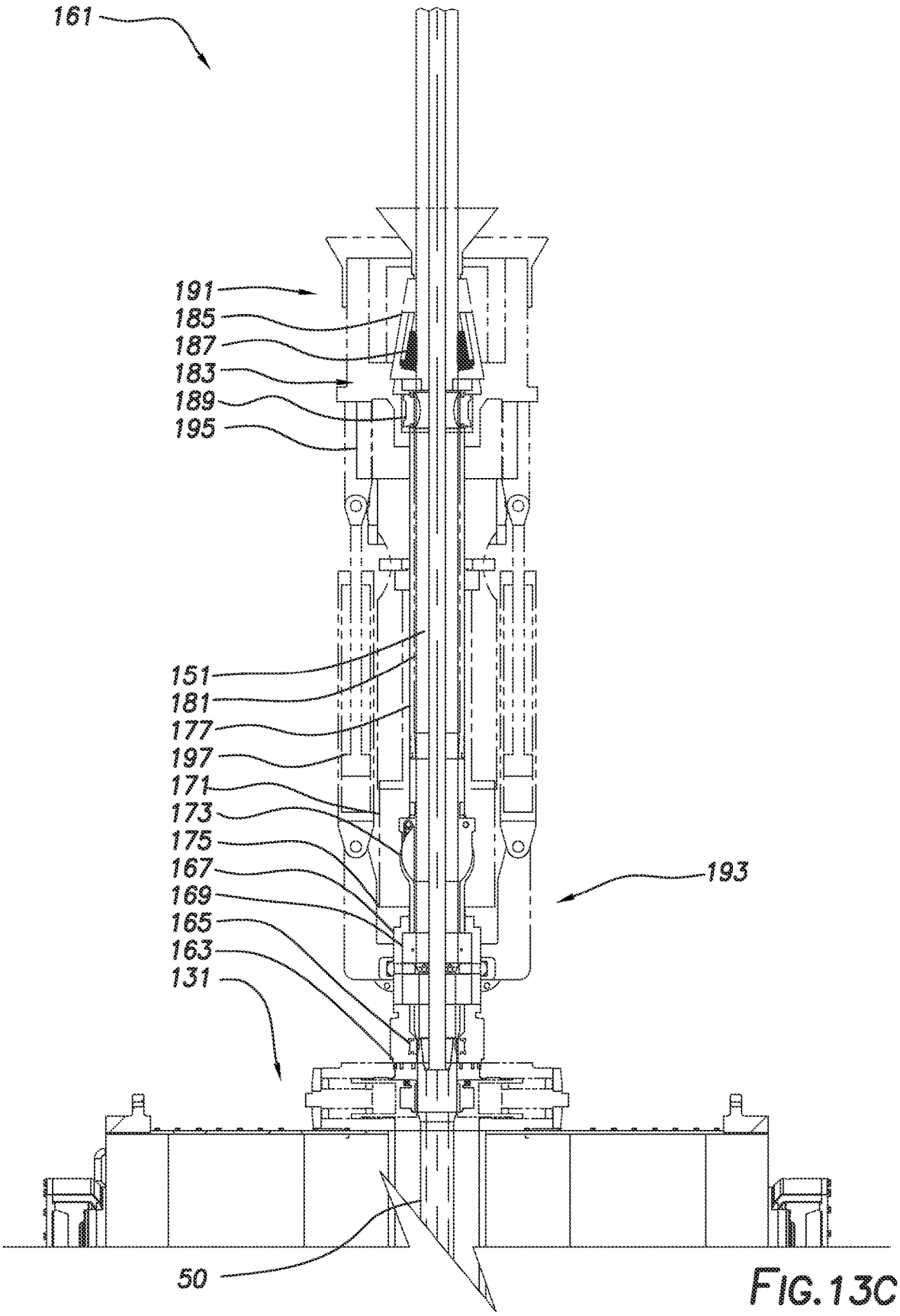

Once LDM 131 is so aligned, LDM 131 may begin to rotate LDM clamps 133 and LDM slips 135 at a speed to match the rotation of drill string 50, i.e. drilling speed. Once the rotation rate is matched, LDM clamps 133 and LDM slips 135 may each be actuated to engage drill string 50. The weight of drill string 50 may thus be transferred from UDM 121 to LDM 131 while both engage drill string 50. Inverted slips assembly 183, and upper seal 189 may be actuated to engage quill extension 151 and lower seal 165 may be actuated to engage drill string 50 as shown in FIG. 13B. The rotating components of CDU 161 may be rotated by rotation of quill extension 151 at the drilling speed. The lower flow path may then be opened to introduce drilling fluid into upper chamber 177 and lower chamber 175 of CDU 161 through inlets 169, equalizing the pressure therein with the pressure in drill string 50 as shown in FIG. 13C.

Figure 14:
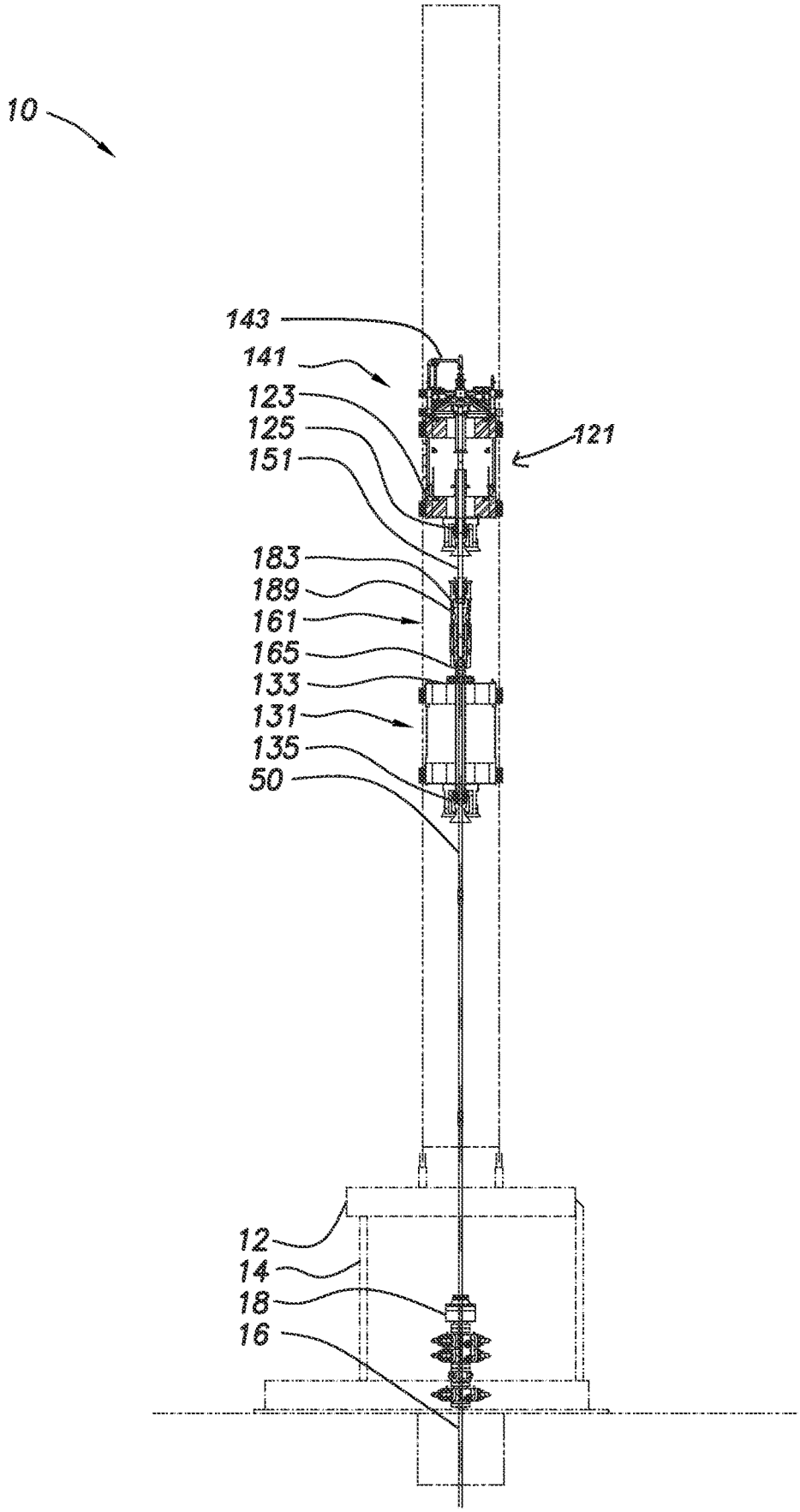
Figure 14A:
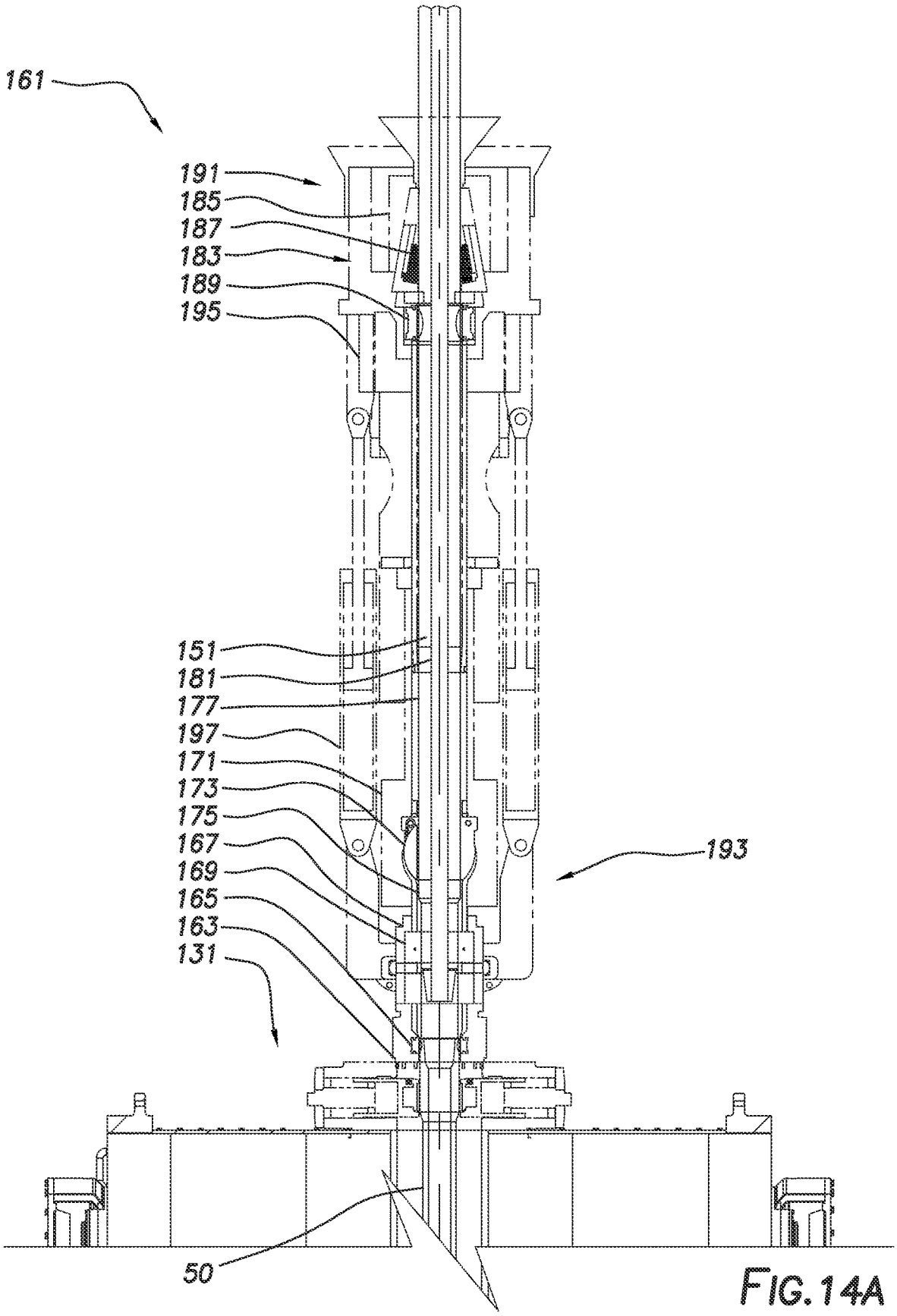

The threaded connection between quill extension 151 and drill string 50 may then be broken-out. As LDM 131 rotates drill string 50 at the drilling speed, UDM 121 may slow rotation of quill extension 151 causing the threaded connection between drill string 50 and quill extension 151 to be broken-out as shown in FIGS. 14 and 14A. UDM 121 may move upward relative to LDM 131 to account for the disengagement of the threaded connection. Likewise, CDU 161 may partially extend to account for the disengagement of the threaded connection. In other embodiments, one or more vertical cylinders may be included as part of UDM 121 or LDM 131 to account for the disengagement of the threaded connection. Once drill string 50 is disconnected from quill extension 151, drilling fluid may enter drill string 50 from the lower flow path via inlets 169, and the upper flow path through UMA 141 may be closed. Rotation of quill extension 151 by UDM 121 may be halted once the connection is broken-out. At this point, LDM 131 bears all the weight and provides the rotational force on drill string 50.

Figure 15:
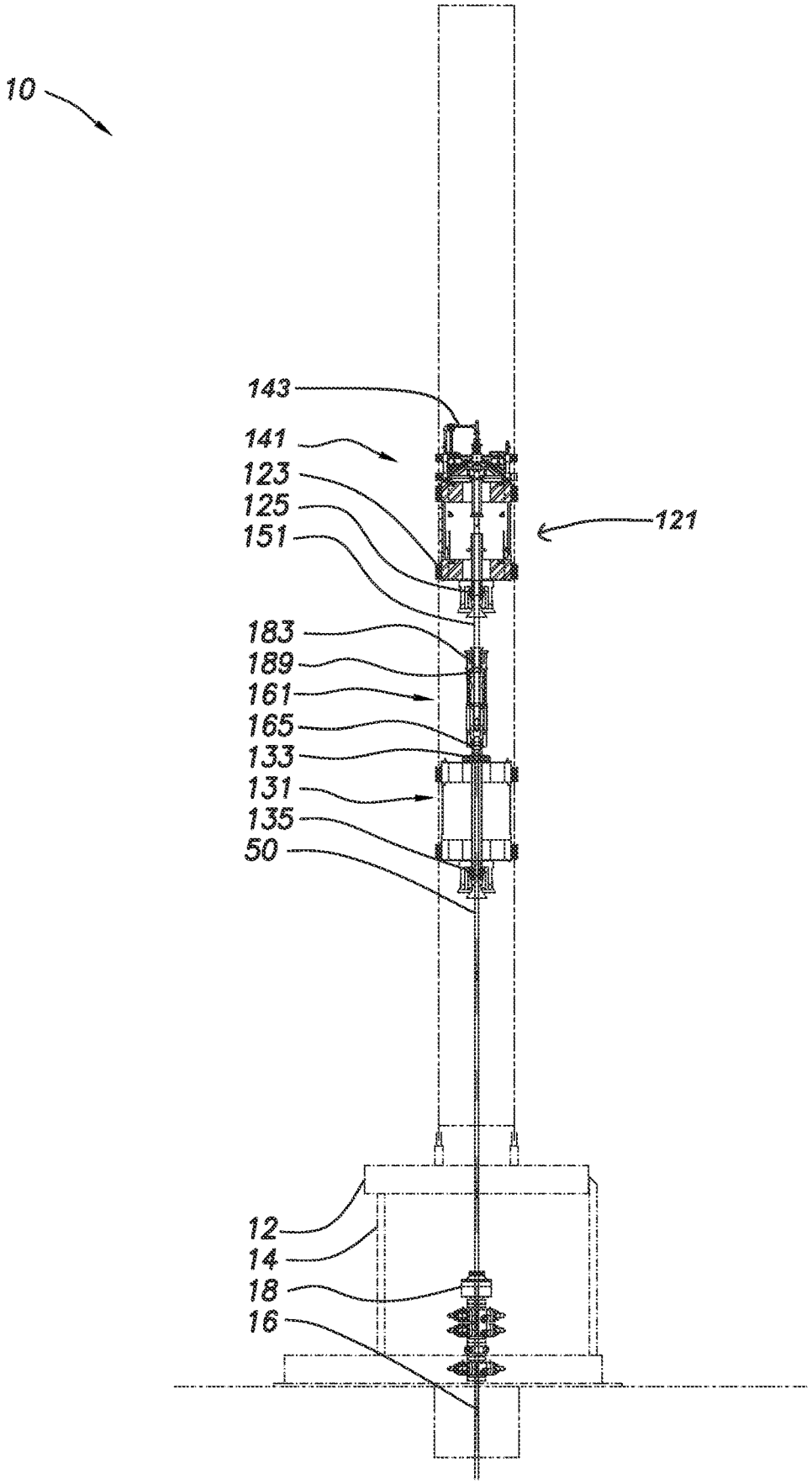
Figure 15A:
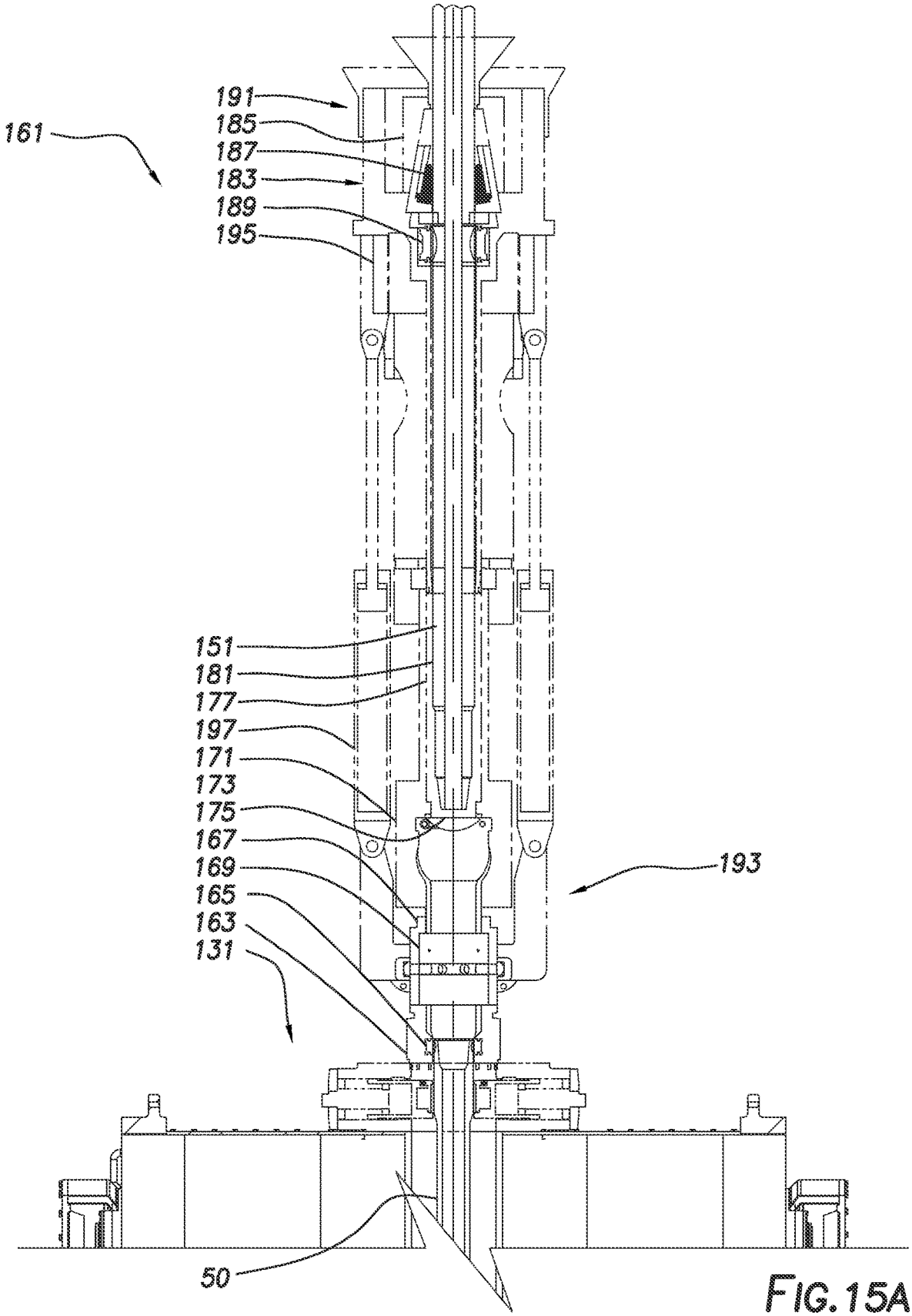
Figure 15B:
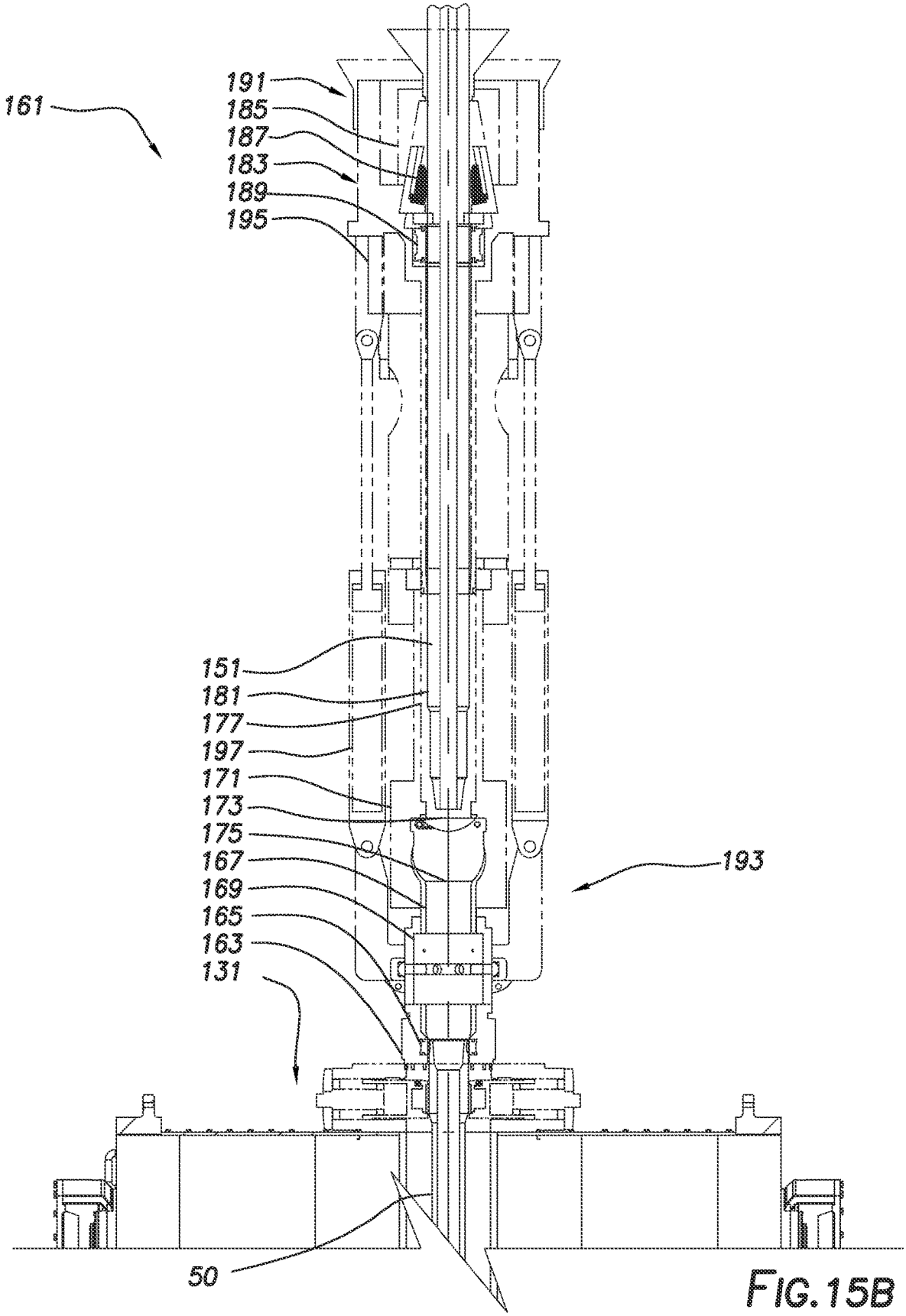
Figure 16:
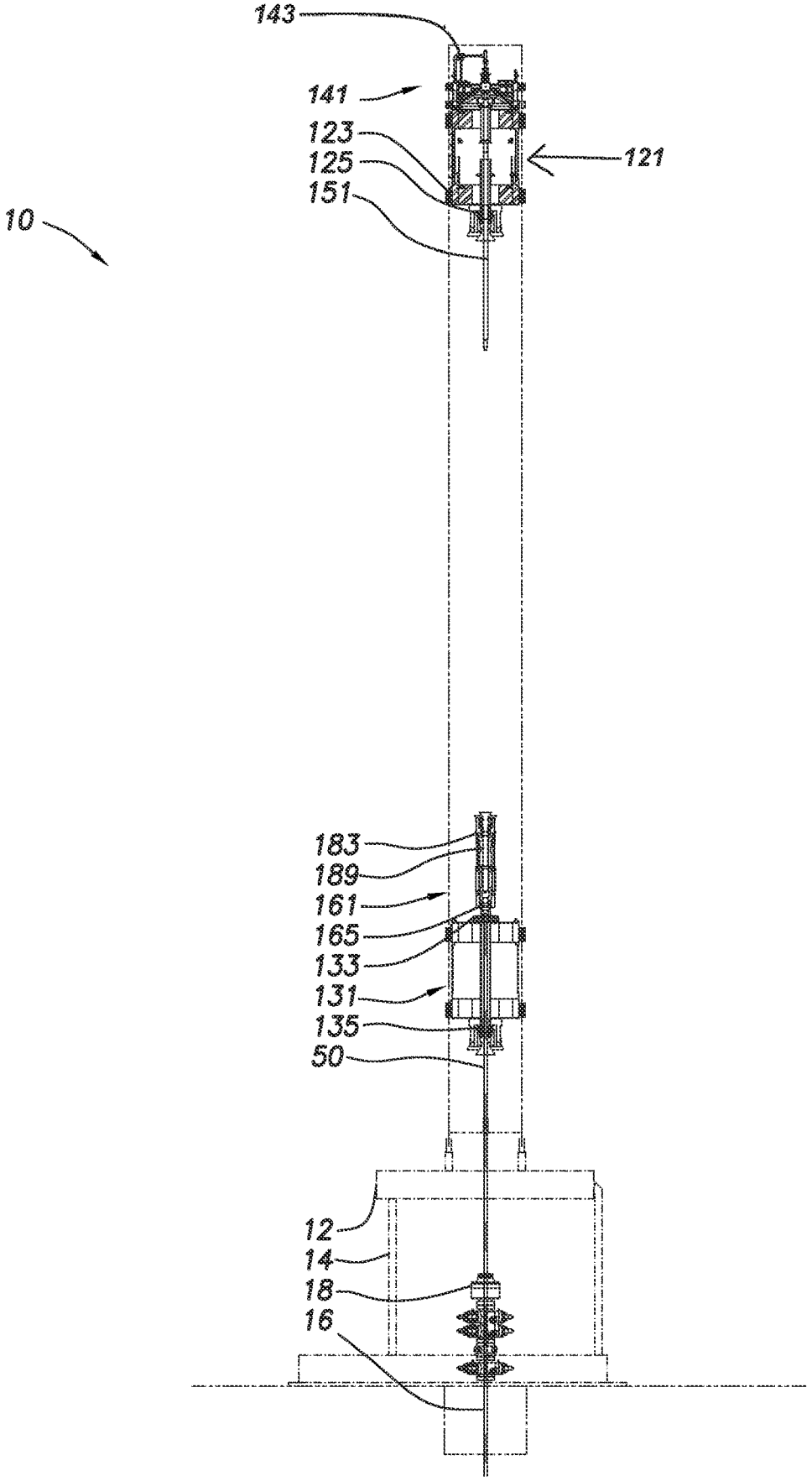

CDU 161 may then fully extend such that the lower end of quill extension 151 moves upward out of lower chamber 175 and into upper chamber 177 of CDU 161 as shown in FIGS. 15 and 15A. Valve 173 may close, isolating lower chamber 175 from upper chamber 177. Upper chamber 177 may be depressurized and fluid within upper chamber 177 and quill extension 151 may be drained. Inverted slips assembly 183 and upper seal 189 may be disengaged from quill extension 151 as shown in FIG. 15B. UDM 121 is disengaged from drill string 50 and may be moved to a raised position relative to mast assembly 100 while LDM 131 runs the drilling operation as shown in FIG. 16.

Figure 17:
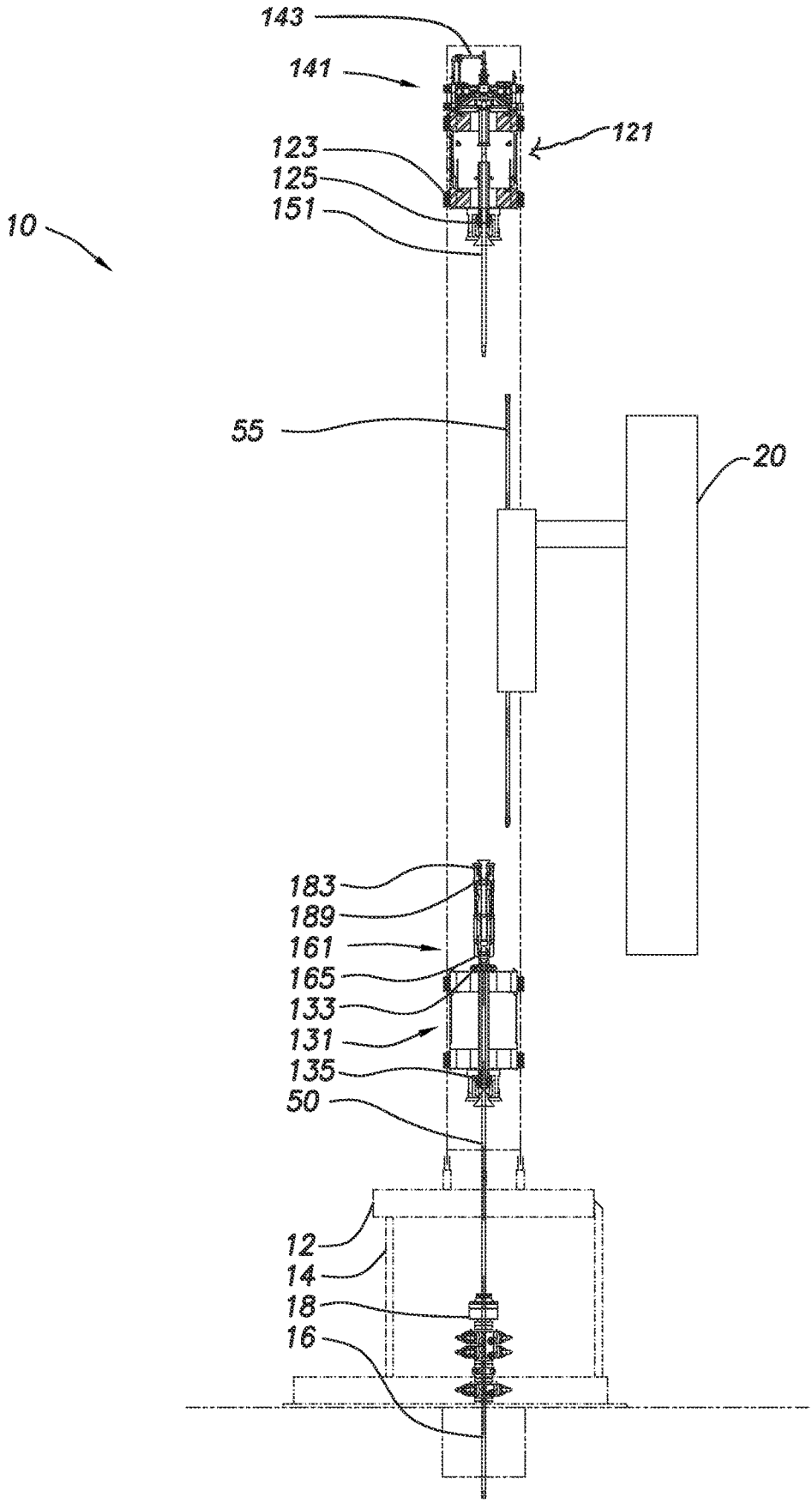

Pipe handler 20 may move a tubular to be added to drill string 50, defined as next drill pipe 55, into position and allow it to be threadedly coupled to the lower end of quill extension 151 as shown in FIG. 17. In some embodiments, the connection between quill extension 151 and next drill pipe 55 may be made-up by rotation of quill extension 151 by UDM 121. In other embodiments, pipe handler 20 may rotate next drill pipe 55 relative to quill extension 151.

Figure 18:
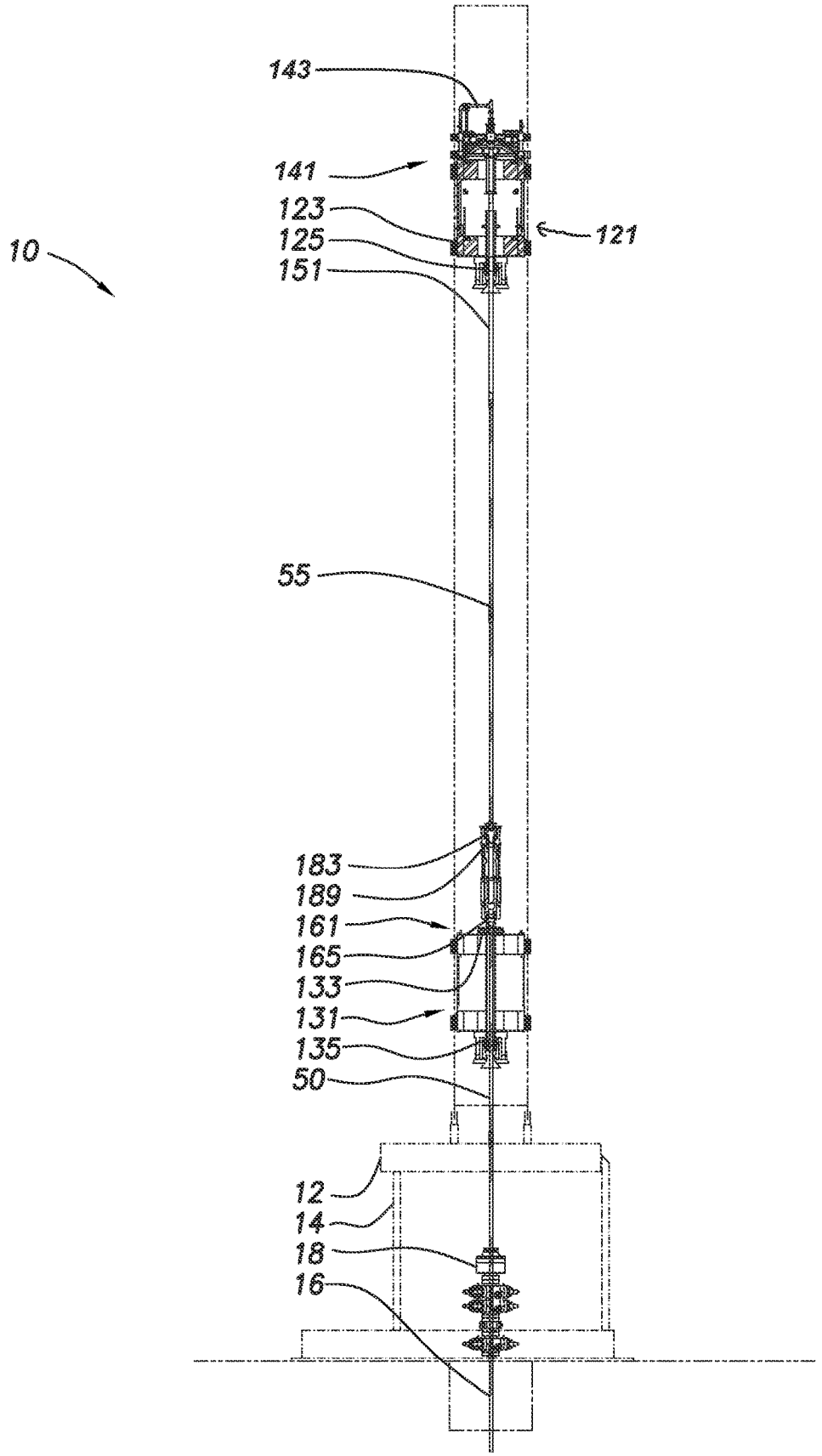
Figure 18A:
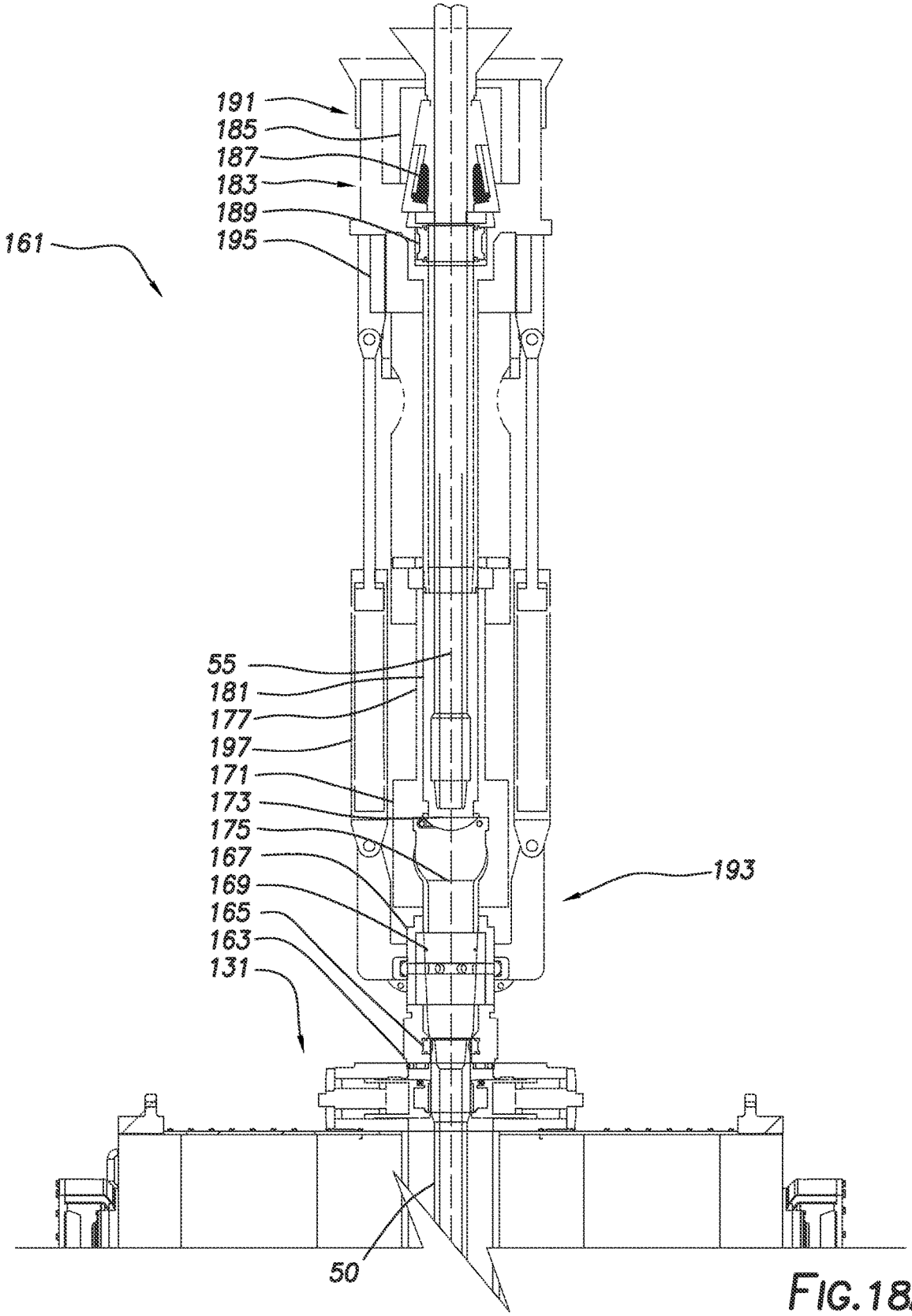
Figure 18B:
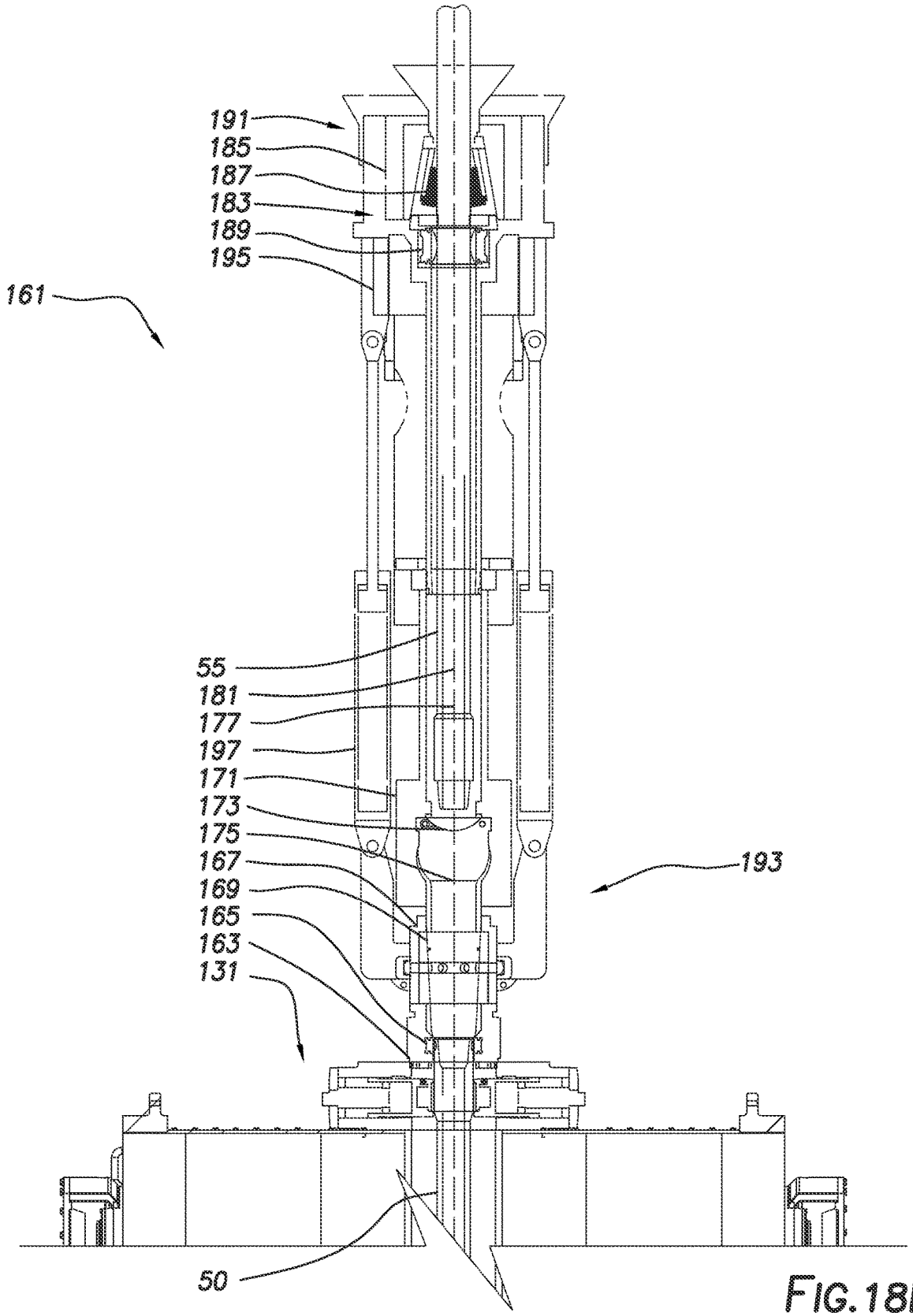
Figure 18C:
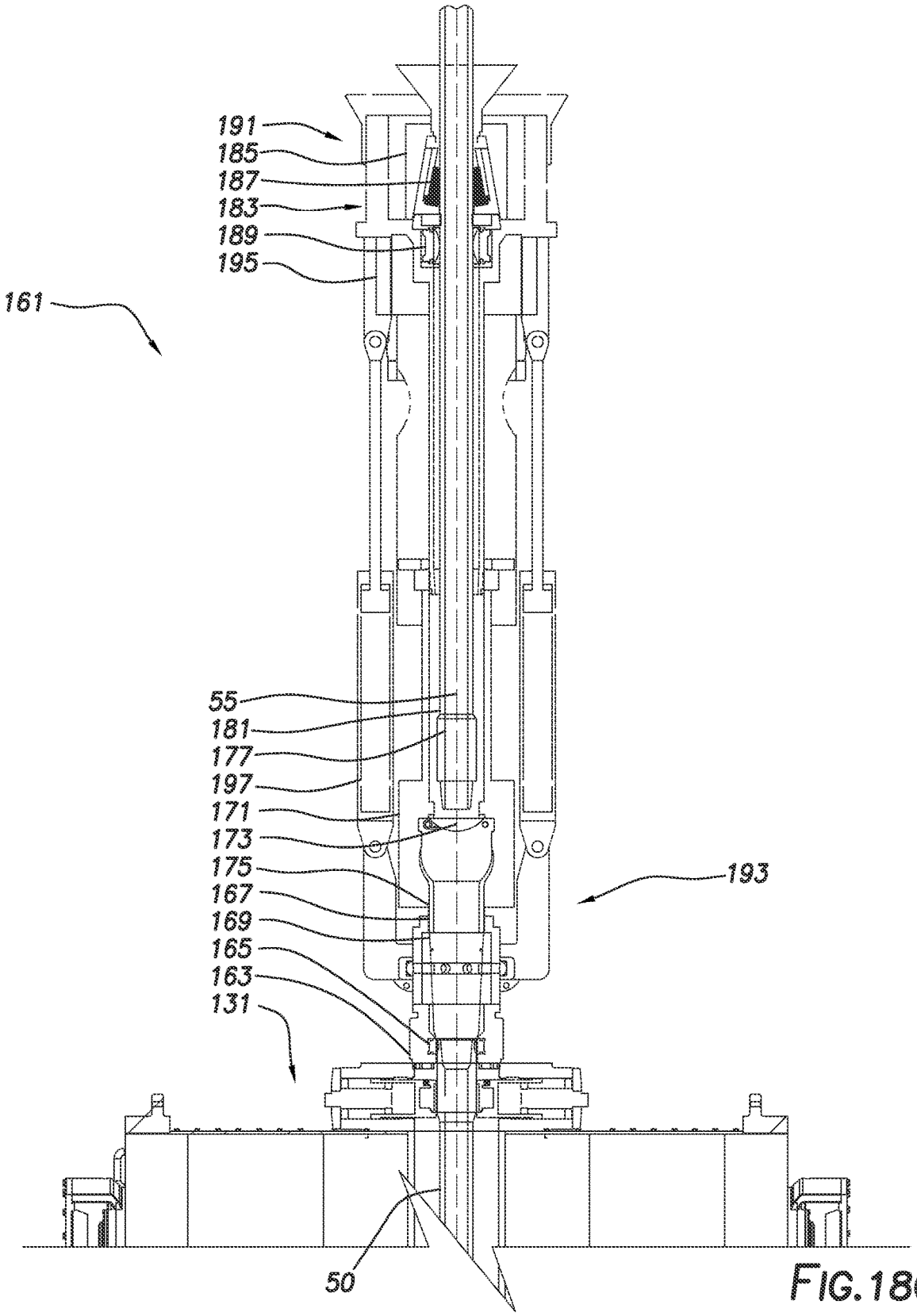

UDM 121 may move downward such that the lower end of next drill pipe 55 is stabbed into upper chamber 177 of CDU 161 as shown in FIGS. 18 and 18A. Inverted slips assembly 183 and upper seal 189 may be engaged against next drill pipe 55 as shown in FIG. 18B. The upper flow path through UMA 141 may be opened, introducing drilling fluid into upper chamber 177 of CDU 161 and equalizing the pressure within upper chamber 177 with the pressure within lower chamber 175 as shown in FIG. 18C.

Figure 19:
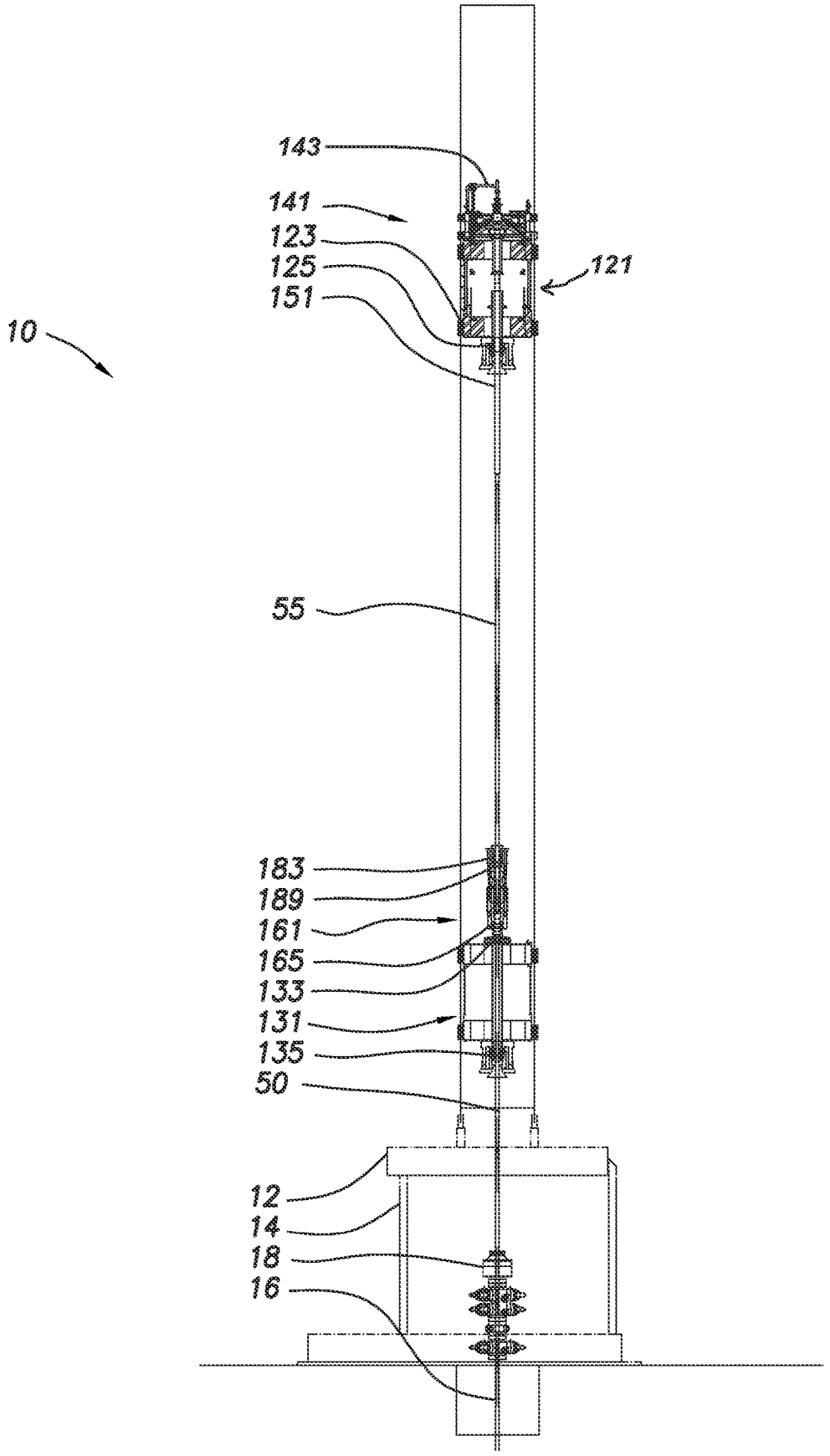
Figure 19A:
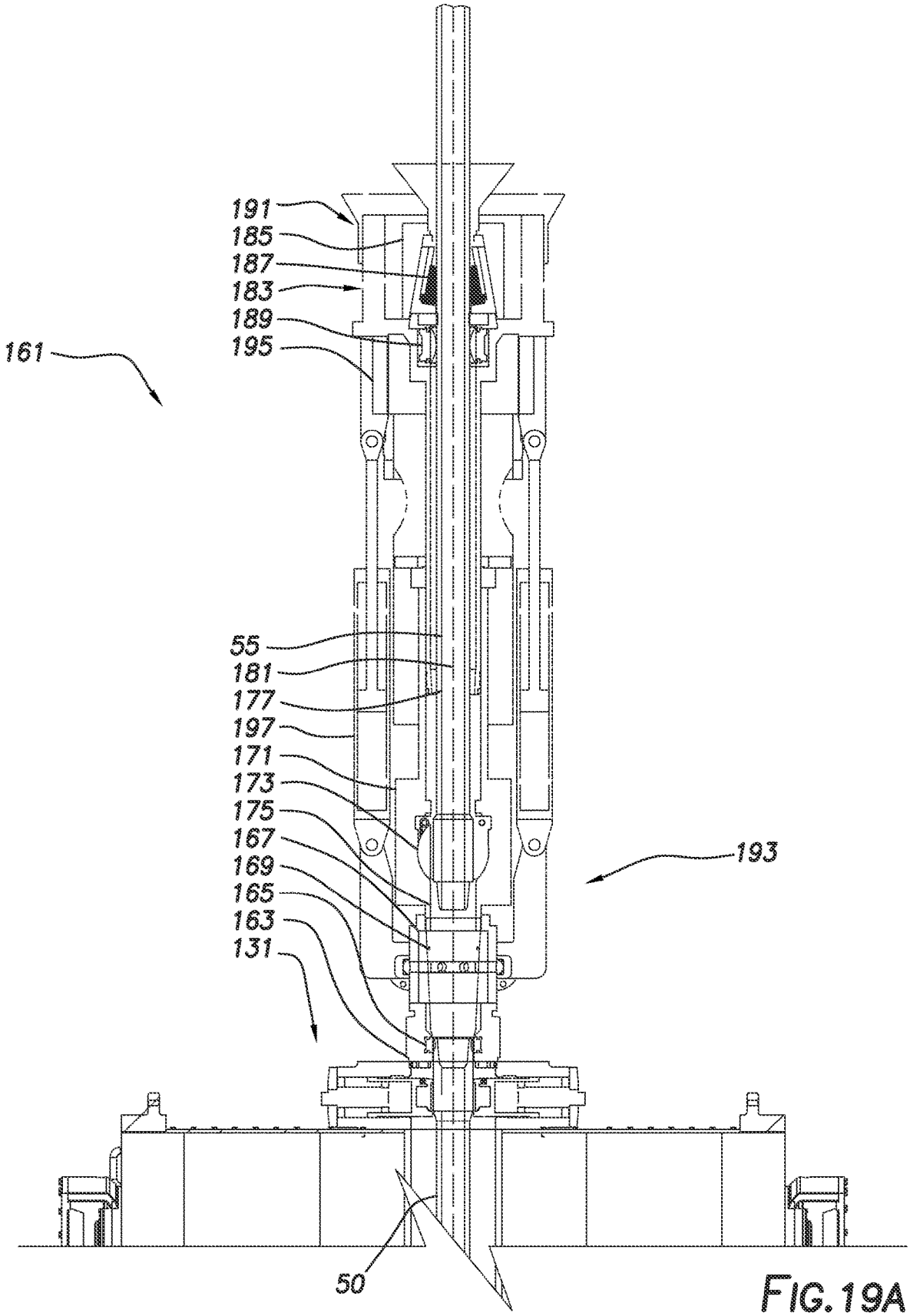

CDU 161 may then be partially retracted, extending the lower end of next drill pipe 55 into lower chamber 175 and opening valve 173 as shown in FIGS. 19 and 19A.

Figure 20:
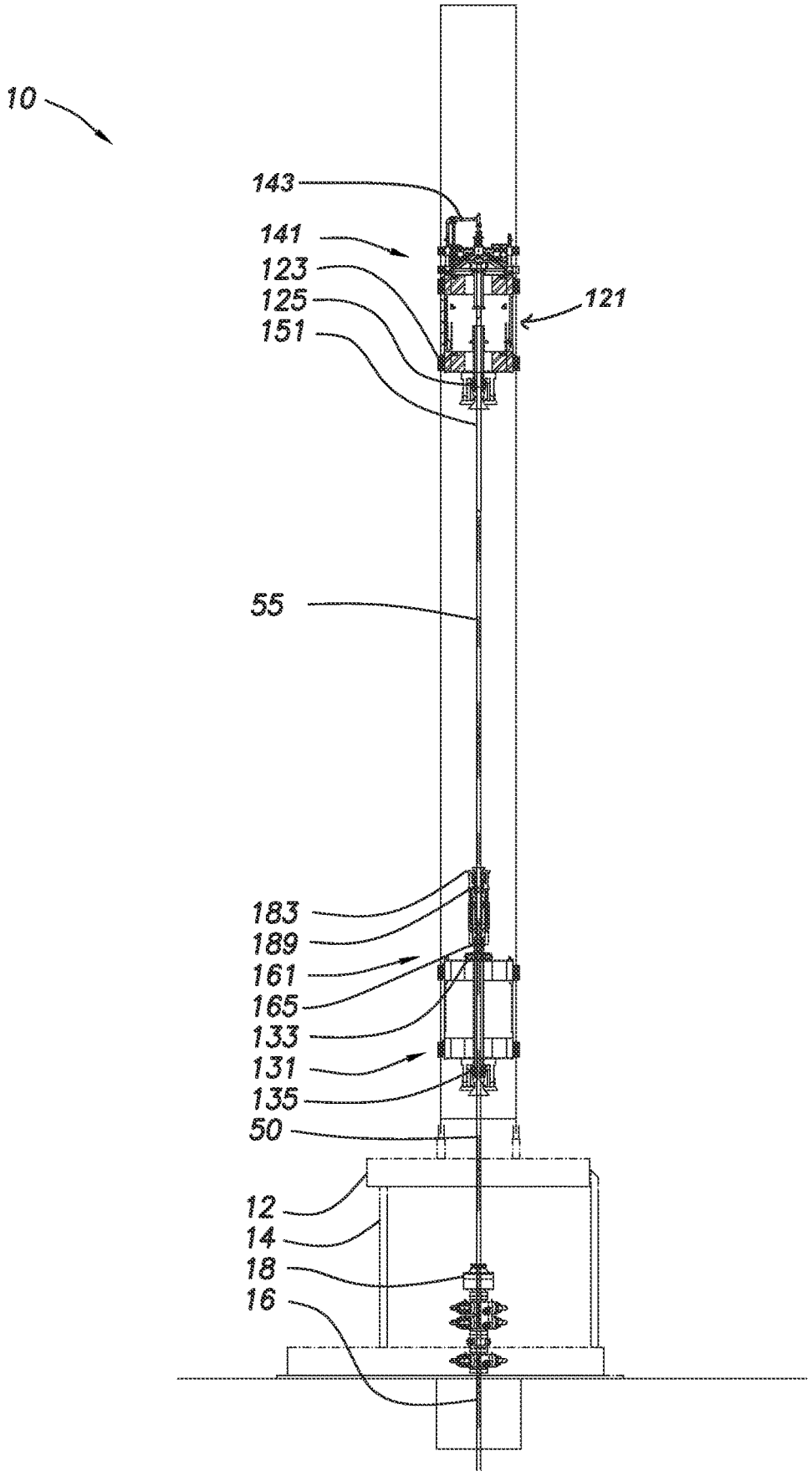
Figure 20A:
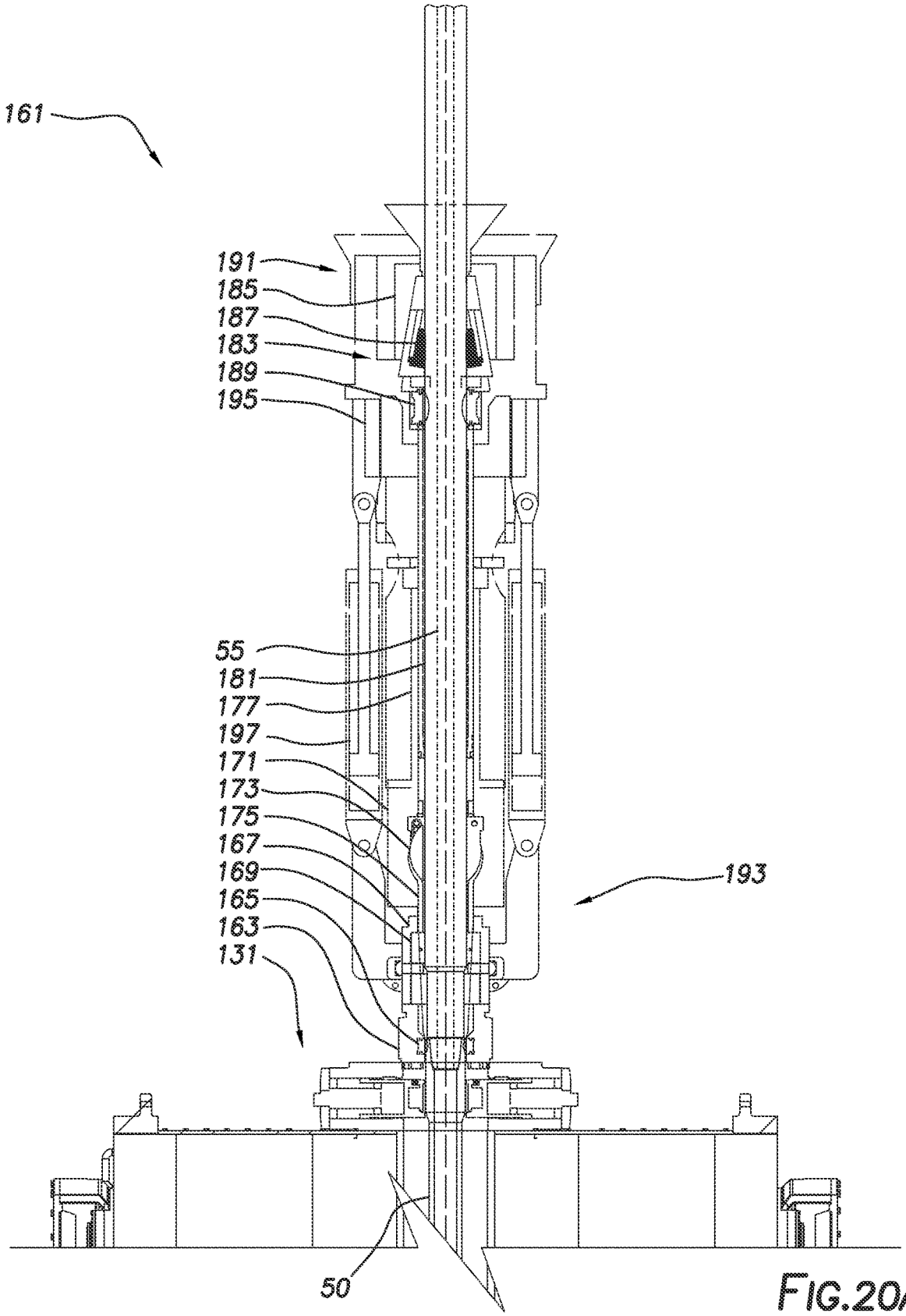
Figure 20B:
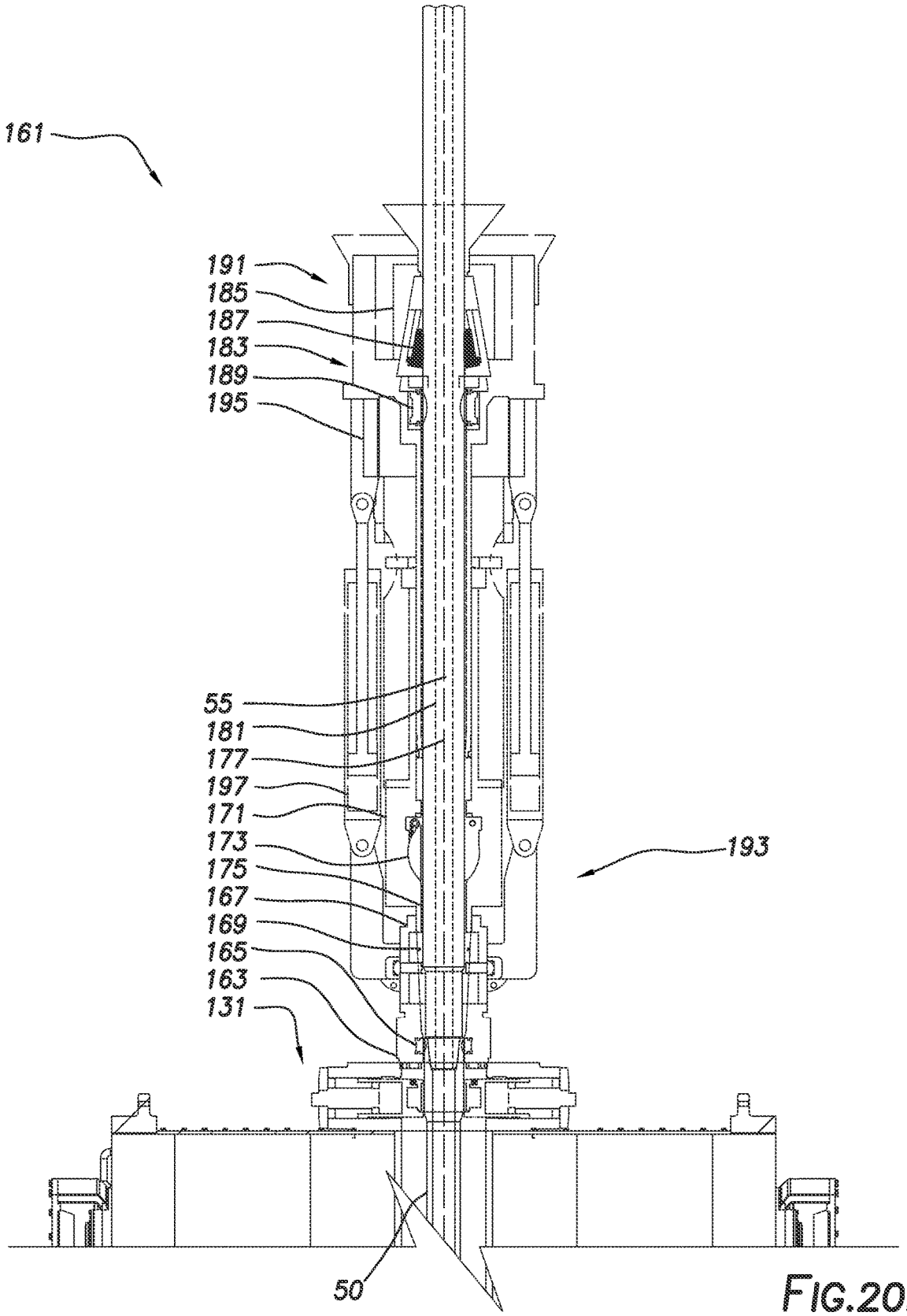
Figure 21:
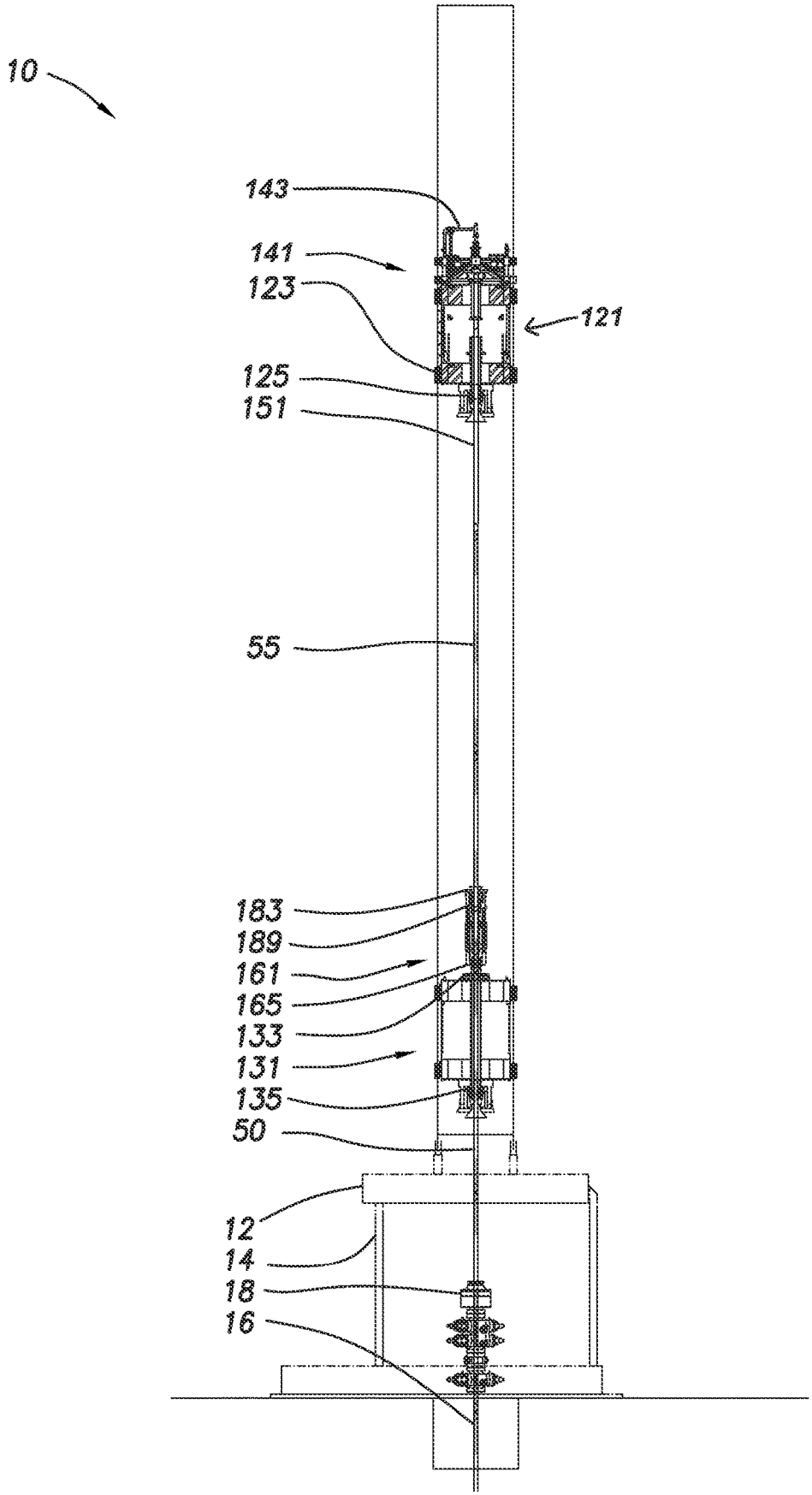
Figure 21A:
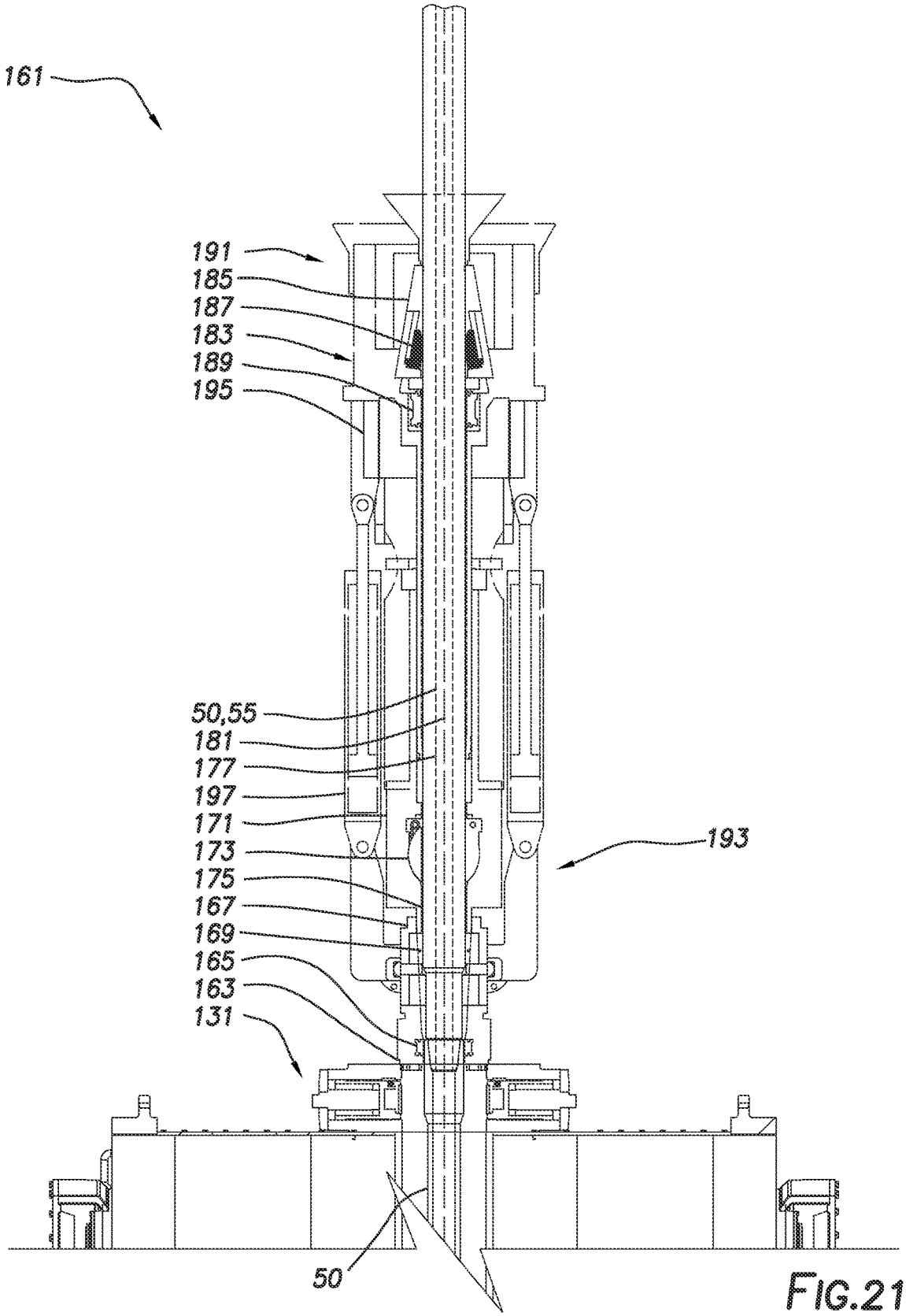

A threaded connection between next drill pipe 55 and drill string 50 may then be made-up. UDM 121 may rotate quill extension 151 and next drill pipe 55 at a speed higher than the drilling speed at which drill string 50 is rotated by LDM 131, defining a make-up speed. UDM 121 may lower and CDU 161 may be retracted as next drill pipe 55 is threadedly coupled to drill string 50 as shown in FIGS. 20 and 20A. Once the threaded connection is complete, UDM 121 may be slowed to rotate quill extension 151 and drill string 50—now including next drill pipe 55—at the drilling speed. The lower flow path through inlets 169 may be closed, and drilling fluid may be drained from upper chamber 177 and lower chamber 175 of CDU 161 as shown in FIG. 20B. The weight of drill string 50 may be transferred from LDM 131 to UDM 121 while both are engaged. UDM 121 and CDU 161 may then be disengaged from drill string 50 as shown in FIGS. 21 and 21A. Specifically, LDM clamps 133, LDM slips 135, lower seal 165, inverted slips assembly 183, and upper seal 189 may be disengaged from drill string 50. Rotation of LDM 131 may be halted. This operation may be repeated each time an additional drill pipe is to be added to drill string 50.

In some embodiments, a similar operation may be undertaken during trip-in or trip-out operations while maintaining continuous mud circulation or rotation of the drill string.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A mast assembly for a drilling rig comprising:

a mast, the mast formed from a plurality of mast subunits;

a lower drilling machine (LDM), the LDM coupled to and movable vertically relative to the mast;

a continuous drilling unit (CDU) mechanically coupled to the LDM, the CDU including an inverted slips assembly, the inverted slips assembly including a slips bowl and one or more wedges positioned to grip a tubular member;

an upper drilling machine (UDM), the UDM coupled to and movable vertically relative to the mast; and an upper mud assembly (UMA), the UMA coupled to and movable vertically relative to the mast;

wherein the mast subunits are separable when the mast is in a transport configuration such that the LDM is positioned in a first subunit and the UDM is in a second subunit of the mast when the mast is in the transport configuration.

2. The mast assembly of claim 1, wherein the mast further comprises a rack, and wherein the LDM, UDM, and UMA each further comprises a pinion engaged with the rack.

3. The mast assembly of claim 1, wherein the UMA comprises a drilling mud supply pipe.

4. The mast assembly of claim 1, wherein the UDM further comprises UDM clamps and a UDM slips.

5. The mast assembly of claim 1, wherein the LDM further comprises LDM clamps and an LDM slips.

6. The mast assembly of claim 1, wherein the mast is adapted to pivot relative to a drilling rig at one or more mast pivot points.

7. The mast assembly of claim 1, wherein the UMA is in a third subunit of the mast when the mast is in the transport configuration.

8. The mast assembly of claim 1, wherein the UMA comprises a drilling mud supply pipe adapted to supply drilling fluid to a tubular member gripped by the UDM defining an upper flow path.

9. The mast assembly of claim 1, wherein the UDM comprises:

UDM clamps, the UDM clamps adapted to engage a tubular member to allow the UDM to rotate the tubular member; and UDM slips, the UDM slips positioned to engage the tubular member to allow the UDM to move the tubular member vertically.

10. The mast assembly of claim 9, wherein the tubular member engaged by the UDM clamps and UDM slips are aligned with the racks of the mast.

11. The mast assembly of claim 1, wherein the LDM comprises:

LDM clamps, the LDM clamps adapted to engage a tubular member to allow the LDM to rotate the tubular member; and LDM slips, the LDM slips positioned to engage the tubular member to allow the LDM to move the tubular member vertically.

12. The mast assembly of claim 11, wherein the tubular member engaged by the LDM clamps and LDM slips are aligned with the racks of the mast.

13. The mast assembly of claim 1, wherein the CDU further comprises:

a lower seal, the lower seal positioned within a lower seal housing, the lower seal positioned to seal against an upper end of a first tubular member gripped by the LDM;

a circulation housing, the circulation housing mechanically coupled to the lower seal housing, the circulation housing including one or more fluid inlets positioned to allow drilling fluid to enter the interior of the circulation housing and flow into the first tubular member, defining a lower flow path;

a valve, the valve positioned within a valve housing, the valve housing coupled to the circulation housing, the space within the lower seal housing, circulation housing, and valve housing between the lower seal and the valve defining a lower chamber;

an outer extension barrel mechanically coupled to the valve housing;

an inner extension barrel positioned within and adapted to slide telescopically within the outer extension barrel, the inverted slips assembly coupled to the inner extension barrel;

an upper seal mechanically coupled to the inner extension barrel, the upper seal positioned to seal against a lower end of a second tubular member, the space within the valve housing, outer extension barrel, and inner extension barrel between the valve and the upper seal defining an upper chamber; and one or more linear actuators positioned to telescopically extend or retract the inverted slips assembly and upper seal vertically relative to the valve housing.

14. A method comprising:

positioning a drilling rig at a well site, the drilling rig including:

a mast assembly, the mast assembly including:

a mast, the mast formed from a plurality of mast subunits;

a lower drilling machine (LDM), the LDM coupled to and movable vertically relative to the mast;

a continuous drilling unit (CDU) mechanically coupled to the LDM, the CDU including an inverted slips assembly, the inverted slips assembly including a slips bowl and one or more wedges positioned to grip a tubular member;

an upper drilling machine (UDM), the UDM coupled to and movable vertically relative to the mast; and an upper mud assembly (UMA), the UMA coupled to and movable vertically relative to the mast, the UMA including a drilling mud supply pipe adapted to supply drilling fluid to a tubular member gripped by the UDM defining an upper flow path;

wherein the mast subunits are separable when the mast is in a transport configuration such that the LDM is positioned in a first subunit and the UDM is in a second subunit of the mast when the mast is in the transport configuration; and continuously drilling a wellbore using the drilling rig.

15. The method of claim 14, wherein:

the UDM comprises:

UDM clamps, the UDM clamps adapted to engage a tubular member to allow the UDM to rotate the tubular member; and UDM slips, the UDM slips positioned to engage the tubular member to allow the UDM to move the tubular member vertically;

the LDM comprises:

LDM clamps, the LDM clamps adapted to engage a tubular member to allow the LDM to rotate the tubular member; and LDM slips, the LDM slips positioned to engage the tubular member to allow the LDM to move the tubular member vertically; and the CDU further comprises:

a lower seal, the lower seal positioned within a lower seal housing, the lower seal positioned to seal against an upper end of a first tubular member gripped by the LDM;

a circulation housing, the circulation housing mechanically coupled to the lower seal housing, the circulation housing including one or more fluid inlets positioned to allow drilling fluid to enter the interior of the circulation housing and flow into the first tubular member, defining a lower flow path;

a valve, the valve positioned within a valve housing, the valve housing coupled to the circulation housing, the space within the lower seal housing, circulation housing, and valve housing between the lower seal and the valve defining a lower chamber;

an outer extension barrel mechanically coupled to the valve housing;

an inner extension barrel positioned within and adapted to slide telescopically within the outer extension barrel, the inverted slips assembly coupled to the inner extension barrel;

an upper seal mechanically coupled to the inner extension barrel, the upper seal positioned to seal against a lower end of a second tubular member, the space within the valve housing, outer extension barrel, and inner extension barrel between the valve and the upper seal defining an upper chamber; and one or more linear actuators positioned to telescopically extend or retract the inverted slips assembly and upper seal vertically relative to the valve housing.

16. The method of claim 15, wherein continuously drilling comprises:

engaging the first tubular member with the LDM clamps, LDM slips, and lower seal;

rotating the first tubular member with the LDM at a first speed, defined as a drilling speed;

closing the valve;

flowing drilling fluid into the first tubular member through the lower flow path;

extending the inverted slips assembly and upper seal vertically with the linear actuators;

engaging the second tubular member with the UDM clamps and UDM slips;

lowering the second tubular member into the CDU;

engaging the second tubular member with the inverted slips and upper seal;

rotating the second tubular member with the UDM at a higher speed than the drilling speed;

flowing fluid through the second tubular member through the upper flow path;

retracting the inverted slips assembly and upper seal with the linear actuators;

opening the valve;

threadedly coupling the first and second tubular members;

rotating the first and second tubular members at the drilling speed with the UDM;

disengaging the LDM clamps, LDM slips, lower seal, inverted slips, and upper seal;

moving the LDM vertically upward such that the LDM clamps are aligned with the top of the second tubular member;

engaging the LDM clamps, LDM slips, and lower seal to the second tubular member;

rotating the second tubular member with the LDM;

disengaging the second tubular member from the UDM; and flowing drilling fluid through the second tubular member through the lower fluid path.

17. The method of claim 16, wherein the second tubular member is engaged to the UDM through a quill extension, the quill extension threadedly coupled to the upper end of the second tubular member.

18. The method of claim 17, wherein disengaging the second tubular member from the UDM comprises:

engaging the quill extension with the inverted slips and the upper seal;

rotating the quill extension with the UDM at a slower speed than the drilling speed;

threadedly disengaging the quill extension from the second tubular member;

extending the inverted slips assembly and upper seal vertically with the linear actuators;

closing the valve; and disengaging the quill extension with the inverted slips and the upper seal.

* * * * *